US010300694B2

(12) United States Patent
Kaburagi et al.

(10) Patent No.: US 10,300,694 B2
(45) Date of Patent: May 28, 2019

(54) PRINTING APPARATUS AND PRINTING METHOD

(71) Applicant: CANON KABUSHIKI KAISHA, Tokyo (JP)

(72) Inventors: Yoshiaki Kaburagi, Kawasaki (JP); Kazuya Koizumi, Tama (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 15/714,092

(22) Filed: Sep. 25, 2017

(65) Prior Publication Data

US 2018/0104951 A1 Apr. 19, 2018

(30) Foreign Application Priority Data

Oct. 18, 2016 (JP) ..... 2016-204289
Oct. 18, 2016 (JP) ..... 2016-204290
Oct. 18, 2016 (JP) ..... 2016-204294

(51) Int. Cl.

*B41J 2/045* (2006.01)
*B41J 2/21* (2006.01)
*B41J 29/393* (2006.01)
*B41J 13/02* (2006.01)
*B41J 25/00* (2006.01)

(52) U.S. Cl.

CPC ..... *B41J 2/04573* (2013.01); *B41J 2/0458* (2013.01); *B41J 2/04543* (2013.01); *B41J 2/04563* (2013.01); *B41J 2/04586* (2013.01); *B41J 2/04591* (2013.01); *B41J 2/2135* (2013.01); *B41J 13/02* (2013.01); *B41J 29/393* (2013.01); *B41J 2025/008* (2013.01)

(58) Field of Classification Search

CPC combination set(s) only.
See application file for complete search history.

(56) References Cited

U.S. PATENT DOCUMENTS 5,434,602 A 7/1995 Kaburagi et al.
5,502,475 A 3/1996 Kaburagi et al.
(Continued)

FOREIGN PATENT DOCUMENTS

JP 2012-179903 A 9/2012

OTHER PUBLICATIONS

U.S. Appl. No. 15/492,360, filed Apr. 20, 2017. Applicant: Kazuya Koizumi.

*Primary Examiner* — Anh T Vo
(74) *Attorney, Agent, or Firm* — Venable LLP

(57) ABSTRACT

A printing apparatus includes a time-division driving unit configured to divide a plurality of printing elements into a plurality of blocks, and between a target reference signal and the next reference signal, and to drive the plurality of printing elements at a time interval for each of the blocks on a basis of the target reference signal to thereby perform one column of printing. In a case where, in a first column, a time, which is after the target reference signal is acquired and until the next reference signal is acquired, is shorter than a time required for one column of printing, the time-division driving unit drives the plurality of printing elements so that a time required for printing the second column, in which the next printing is performed, becomes shorter than a time required for one column of printing in the first column.

20 Claims, 31 Drawing Sheets

(56) References Cited

U.S. PATENT DOCUMENTS

| | | | | |
|---|---|---|---|---|
| 6,027,198 | A * | 2/2000 | Tanaka | B41J 2/04541 347/12 |
| 6,107,781 | A | 8/2000 | Kaburagi | |
| 8,162,432 | B2 * | 4/2012 | Hayashi | B41J 2/04505 347/19 |
| 8,979,231 | B2 | 3/2015 | Nieda et al. | |
| 9,457,590 | B2 | 10/2016 | Koizumi et al. | |

* cited by examiner

| OVERLAPPING NUMBER (ADDRESS) | DIVISION DRIVING INTERVAL |
|---|---|
| 1 | DIVISION DRIVING INTERVAL 1 |
| 2 | DIVISION DRIVING INTERVAL 2 |
| 3 | DIVISION DRIVING INTERVAL 3 |
| 4 | DIVISION DRIVING INTERVAL (MINIMUM VALUE) |
| 5 | DIVISION DRIVING INTERVAL (MINIMUM VALUE) |
| 6 | DIVISION DRIVING INTERVAL (MINIMUM VALUE) |
| 7 | DIVISION DRIVING INTERVAL (MINIMUM VALUE) |

FIG.11

PRINTING APPARATUS AND PRINTING METHOD

BACKGROUND OF THE INVENTION

Field of the Invention

The present invention relates to a printing apparatus and a printing method, and particularly relates to a technique for adjusting the print timing of a dot in response to a fluctuation in the conveying speed of a printing medium.

Description of the Related Art

Japanese Patent Laid-Open No. 2012-179903 describes that, in the case where the conveying speed of a printing medium fluctuates, the number of rasters (lines) to be printed is adjusted while a conveying roller conveying the printing medium rotates once. This allows one line of dots formed on the printing medium to be printed at a predetermined interval regardless of the fluctuation in the conveying speed. Specifically, in a configuration for driving in a time-division manner a plurality of nozzles forming a column of nozzles, a table is prepared in advance in which the number of units of pulse trains, the unit being a time-division drive timing signal for performing one line (one raster) of printing, corresponds to the conveying speed of a printing medium. Then, the conveying speed is detected, the table is searched with this speed, and a printing head is driven with the number of pulse trains, the number corresponding to the conveying speed, while the conveying roller rotates once.

However, in the drive timing control of Japanese Patent Laid-Open Patent No. 2012-179903, the above-described one raster of pulse trains is controlled to be output with an edge signal of an encoder as a reference signal, and the output timing of this pulse train is the one defined in the table. Namely, in Japanese Patent Laid-Open No. 2012-179903, between the reference signal and the next reference signal, one raster of pulse trains is arranged with reference to the previous reference signal, and this arrangement and the number of pulse trains differ for each conveying speed. Accordingly, in the case where the output of a pulse train was started on the basis of a reference signal but the next reference signal was output to a drive circuit earlier due to a certain fluctuation in the conveying speed, the reference signal is input in the middle of one raster of pulse trains, namely, before the driving of all the time division drive blocks forming one line is completed. In contrast, the drive timing control according to Japanese Patent Laid-Open No. 2012-179903 cannot correspond to this case. In this case, e.g., in the configuration of a drive circuit which does not allow the drive with the next pulse train to be performed as error processing, the next one line of printing will be omitted.

Furthermore, there is known a configuration in which in printing head drive control, the information (e.g., head temperature) about a printing head for each reference signal in time division driving is acquired. In acquiring this head information, head information acquisition is performed at a timing not overlapping with the drive for ejection from a nozzle, from the viewpoint of avoiding the influence of noise, and the like. In such a configuration for performing the acquisition of head information for each reference signal in time division driving, the possibility of overlapping with a reference signal that is input at a timing earlier, by the amount of the acquisition time, than the above-described predetermined timing increases, and thus problems such as omission of printing become more remarkable.

SUMMARY OF THE INVENTION

The present invention solves the above-described problems, and provides a printing apparatus and a printing method which can prevent, in driving a printing head in a time division manner, image quality degradation such as omission of printing, even if the interval between a reference signal specifying a time interval of time division driving and the next reference signal becomes short due to a fluctuation in conveying speed of a printing medium.

In one aspect, the present invention provides a printing apparatus for printing, the printing apparatus comprising a printing head having a plurality of printing elements arranged in a predetermined direction, the printing head being for printing a column including dots aligned in the predetermined direction, a conveying unit configured to convey a printing medium in a direction intersecting with the predetermined direction, a signal acquisition unit configured to acquire a reference signal which is sequentially output in response to conveyance of the printing medium by the conveying unit, and a time-division driving unit configured to divide the plurality of printing elements into a plurality of blocks, and, in a time period after a target reference signal is acquired by the signal acquisition unit and until a next reference signal of the target reference signal is acquired, to drive the plurality of printing elements at a time interval for each of the blocks on a basis of the target reference signal to thereby perform one column of printing, wherein the time-division driving unit drives, in a case where, in a first column, a time after the target reference signal is acquired by the signal acquisition unit and until the next reference signal is acquired is shorter than a time required for driving the plurality of printing elements for one column of printing by the time-division driving unit, the plurality of printing elements so that a time required for driving the plurality of printing elements for one column of printing by the time-division driving unit in a second column in which printing is performed after the first column becomes shorter than a time required for driving the plurality of printing elements for one column of printing by the time-division driving unit in the first column.

With the above-described configurations, it becomes possible to prevent, in driving a printing head of a printing apparatus in a time division manner, image quality degradation such as omission of printing, even if the interval between a reference signal specifying a time interval of time division driving and the next reference signal becomes short due to a fluctuation in conveying speed of a printing medium.

Further features of the present invention will become apparent from the following description of exemplary embodiments with reference to the attached drawings.

BRIEF DESCRIPTION OF THE DRAWINGS

FIG. 11 is a diagram for illustrating the contents of a division driving interval memory;

DESCRIPTION OF THE EMBODIMENTS

Figure 1A:
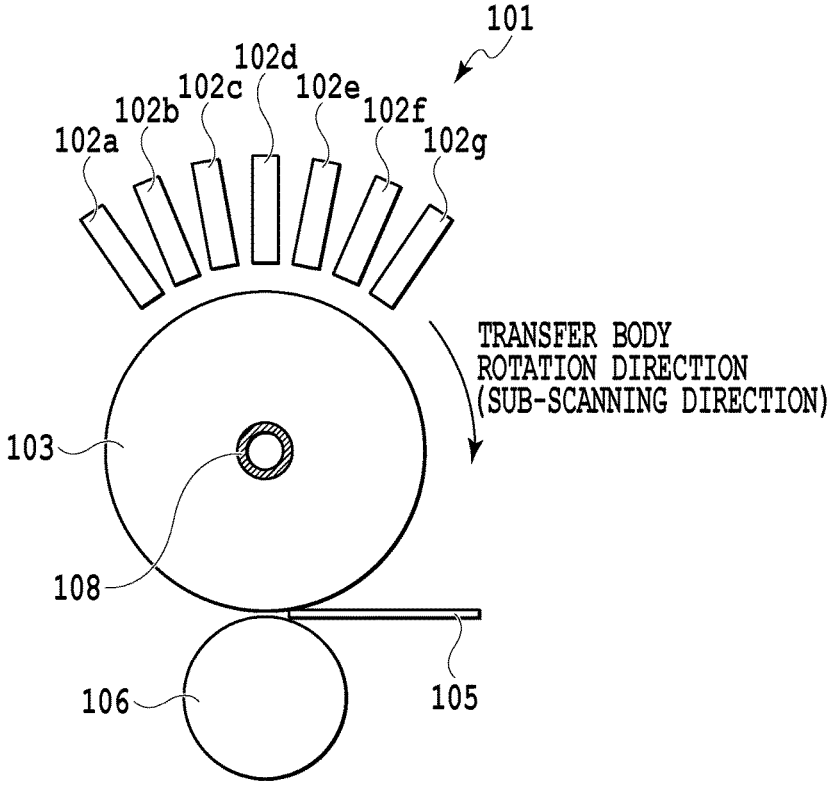
FIG. 1A and FIG. 1B are diagrams for illustrating the configuration of a main portion of an inkjet printing apparatus according to the present invention.

Hereinafter, embodiments of the present invention will be explained in detail referring to the drawings.

First, the time division driving according to a first embodiment, second embodiment, and third embodiment executed in a printing apparatus according to the present invention will be explained. Here, the basic configuration of the printing apparatus which performs the time division driving will be explained.

Figure 1B:
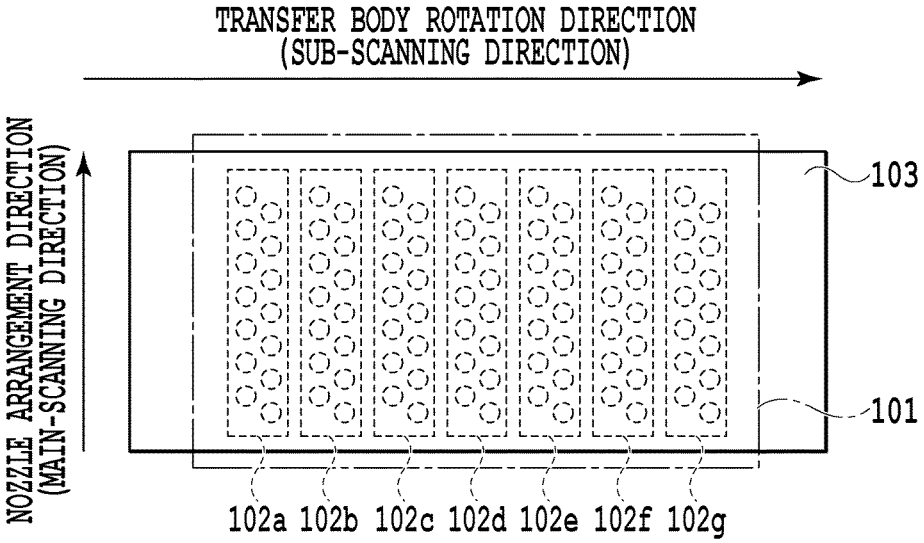

FIG. 1A and FIG. 1B illustrate the configuration of a main portion of an inkjet printing apparatus according to the present invention, in which FIG. 1A illustrates a printing unit which is the main portion of the printing apparatus, while FIG. 1B particularly illustrates a relationship between a printing head and a printing medium. Note that, in this specification, the inkjet printing apparatus is also referred to as a "printing apparatus". This printing apparatus provided with a printing unit 101 illustrated in FIG. 1A performs image formation on a printing sheet by transferring an image printed on a transfer body onto a continuously fed printing sheet, and is a full-line type printing apparatus corresponding to both the single-sided printing and the double-sided printing. Such a printing apparatus is suitable, e.g., in the field where a large number of sheets are printed in a factory, etc.

The printing unit 101 is provided with a drum-like transfer body (first printing medium) 103 which is rotated by a non-illustrated driving mechanism. Seven printing heads 102*a*, 102*b*, 102*c*, 102*d*, 102*e*, 102*f*, and 102*g*, each ejecting inks of different colors, are arranged in the rotation direction of this transfer body 103, and an image is formed on the transfer body 103 by sequentially ejecting ink onto the surface of the rotating transfer body 103 from these printing heads. The printing heads 102*a*, 102*b*, 102*c*, 102*d*, 102*e*, 102*f*, and 102*g* each are the so-called line-type printing heads each having a plurality of inkjet-type nozzles arranged in a range which covers the maximum width of the transfer body 103, assumed to be used. Each printing head has two columns of nozzles arranged therein, and these two columns of nozzles are arranged shifting from each other by a half a nozzle arrangement pitch. Then, from the seven printing heads, e.g., the inks of C (cyan), M (Magenta), Y (yellow), K (black), Lc (light cyan), Lm (light Magenta), and Gy (gray) are respectively ejected. Each of these printing heads is provided with a heater (printing element) corresponding to each nozzle, and ejects ink from the corresponding nozzle by utilizing the heat generated by driving the heater. Note that, in the application of the present invention, it is needless to say that the number of ink colors and/or the number of printing heads are not limited to seven.

A conveying roller 106 is provided so as to come into contact with the transfer body 103 and is rotated in a direction opposite to the transfer body 103 by a non-illustrated conveying mechanism. Thus, an image formed in the surface of the transfer body 103 can be transferred onto a printing sheet (second printing medium) 105 conveyed by a non-illustrated conveying mechanism.

An encoder 108 is connected onto the axis of the transfer body 103, while an encoder sensor 109 (FIG. 22) is provided at a position where it can detect the encoder 108. Accordingly, the encoder 108 rotates together with the rotation of the transfer body 103, and the encoder sensor detects this rotation of the encoder 108, and thus outputs an encoder signal associated with the rotation of the transfer body 103. Then, this encoder signal serves as a reference for a time-division drive timing signal in driving a printing head, as described in FIG. 2 and thereafter. Note that the encoder is not limited to the form of being attached onto the axis of a transfer body. Furthermore, a reference position sensor (not illustrated) is arranged for outputting a signal giving notification of the point of origin of the encoder once every time the encoder makes one round together with the transfer body.

Figure 2:
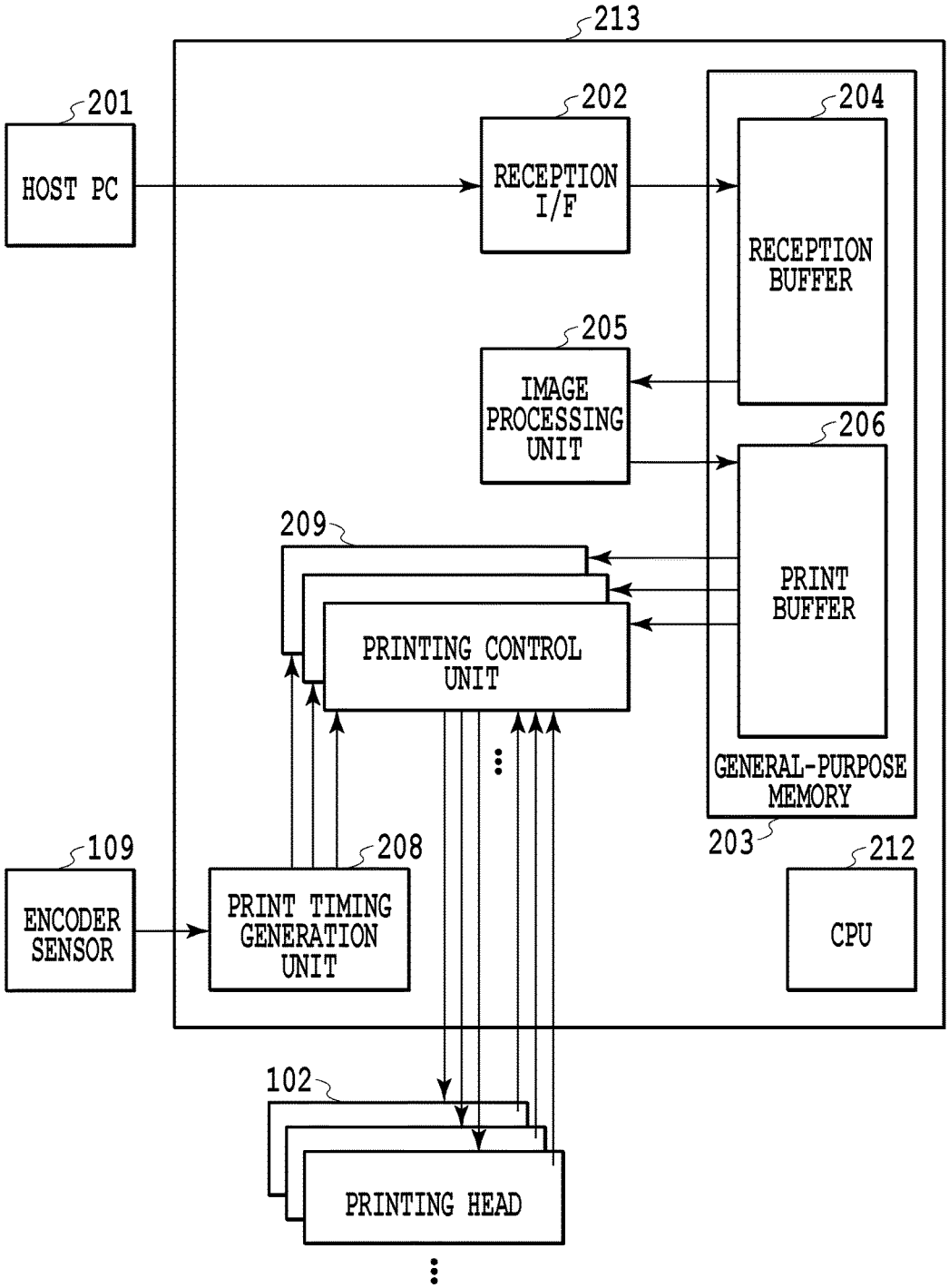
FIG. 2 is a block diagram mainly illustrating the control configuration of the printing apparatus.

FIG. 2 is a block diagram illustrating the control configuration of a printing apparatus provided with the printing unit 101, and mainly illustrates the configuration of an ASIC which performs the generation of print data and the drive control of a printing head. In this ASIC 213, a reception buffer 204 constituting a general-purpose memory 203 stores the image data received via a reception I/F 202 from a host PC 201. An image processing unit 205 reads the image data from the reception buffer 204, performs various types of processing, and finally performs quantization processing to thereby generate print data. This print data is stored into a print data buffer 206 of the general-purpose memory 203.

A print timing generation unit 208 outputs a print (ejection) timing signal on the basis of an encoder signal input from the encoder sensor 109, as described later in FIG. 3 and FIG. 4. A printing control unit 209 outputs, at a timing based on the print timing signal generated by the print timing generation unit 208, print data indicative of the ejection or non-ejection of ink to the printing head 102. This printing control unit 209 is provided for each ink color. The respective printing heads 102 corresponding to these printing control units 209 eject ink onto a printing medium on the basis of the transmitted print data to thereby print an image.

The reception buffer 204 and print data buffer 206 are a part of a main memory such as a DRAM, of this system, but are not required to be a DRAM, and may be a memory such as an SRAM: other than the DRAM as long as they belong to the category of the definition of a RAM. A CPU 212 controls the whole system of the ASIC 213.

Figure 3:
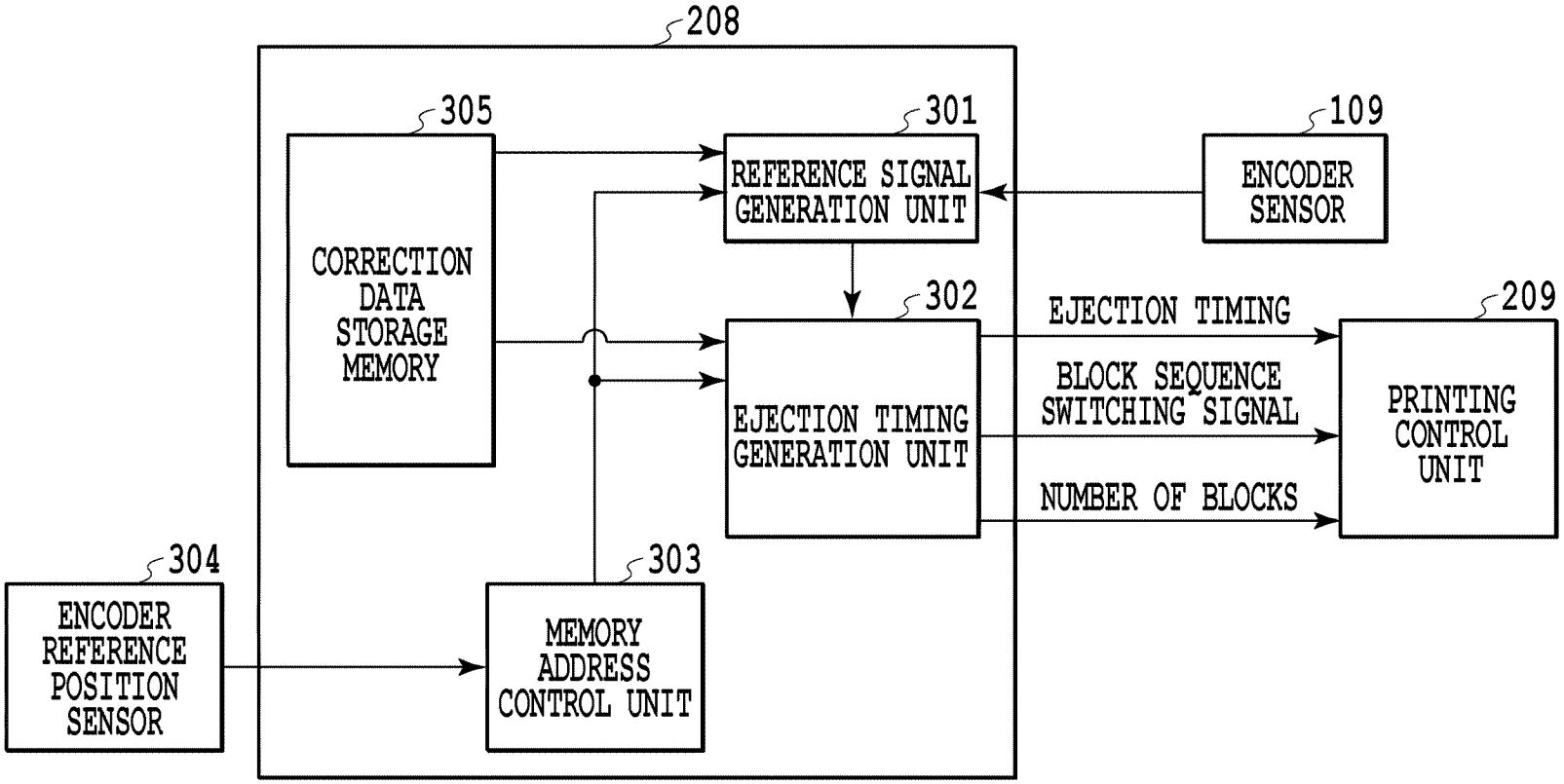
FIG. 3 is a block diagram illustrating the detailed configuration of a print timing generation unit.

FIG. 3 is a block diagram illustrating the detailed configuration of the print timing generation unit 208 according to an embodiment of the present invention. In this configuration, a reference signal generation unit 301 sequentially outputs, on the basis for the encoder signal from the encoder sensor 109, a reference signal serving as a reference for generating the print (ejection) timing. Specifically, the generation of an ejection timing as later described in FIG. 4, FIG. 8, etc. is performed. By receipt of the reference signal from a reference signal generation unit 301 (acquisition of a reference signal), an ejection timing generation unit 302 generates, between consecutive reference signals, a signal of ejection timing based on the information (division drive timing, a delay value from the reference signal, etc.) about the ejection timing signal. The ejection timing information is stored at a location (address), with an encoder reference position sensor 304 (point of origin) as the reference, in a correction data storage memory 305. A memory address control unit 303 generates address information on the basis of a signal from the encoder reference position sensor 304. The ejection timing generation unit 302 reads ejection timing signal information inside the correction data storage memory 305 on the basis of this address information, and generates an ejection timing corresponding to the location. The generation of the information about a block sequence switching signal output by the ejection timing generation unit 302 and the number of blocks will be described later.

Figure 4:
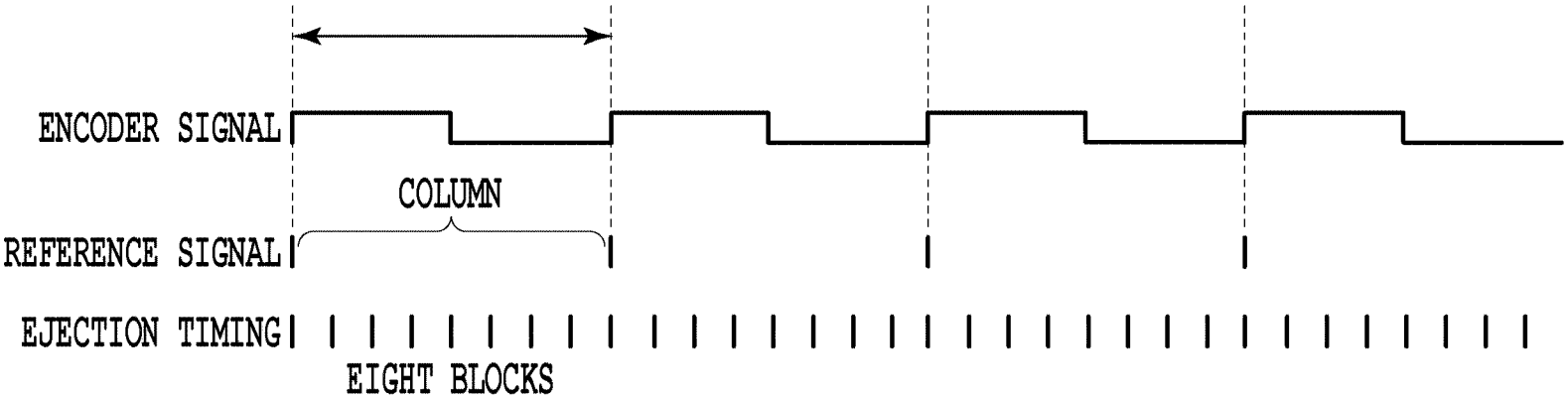
FIG. 4 is a timing chart for explaining an example of the print timing generated by an ejection timing generation unit.

FIG. 4 is a timing chart for explaining an example of the ejection timing generated by the ejection timing generation unit 302, and illustrates eight blocks of ejection timing in time division driving. The example illustrated in FIG. 4 illustrates the ejection timing during normal time in which there is no fluctuation in the conveying speed of a printing medium. In the generation of the ejection timing, a reference signal is generated on the basis of an encoder signal from the encoder sensor 109, as described in FIG. 3. Then, between this reference signal and the next reference signal (within one column of time interval), an ejection timing signal of each of the eight drive blocks formed by dividing, into eight, the nozzles arranged in the main-scanning direction illustrated in FIG. 1B is output. Note that this ejection timing is generated in accordance with a corrected location indicated by the ejection timing signal information inside the correction data storage memory 305, as described above. Note that FIG. 4 illustrates an example of applying the present invention to one-eighth (division into eight) time division driving, but it is apparent from the description of this specification that the application of the present invention is not limited to this division number.

Figure 5:
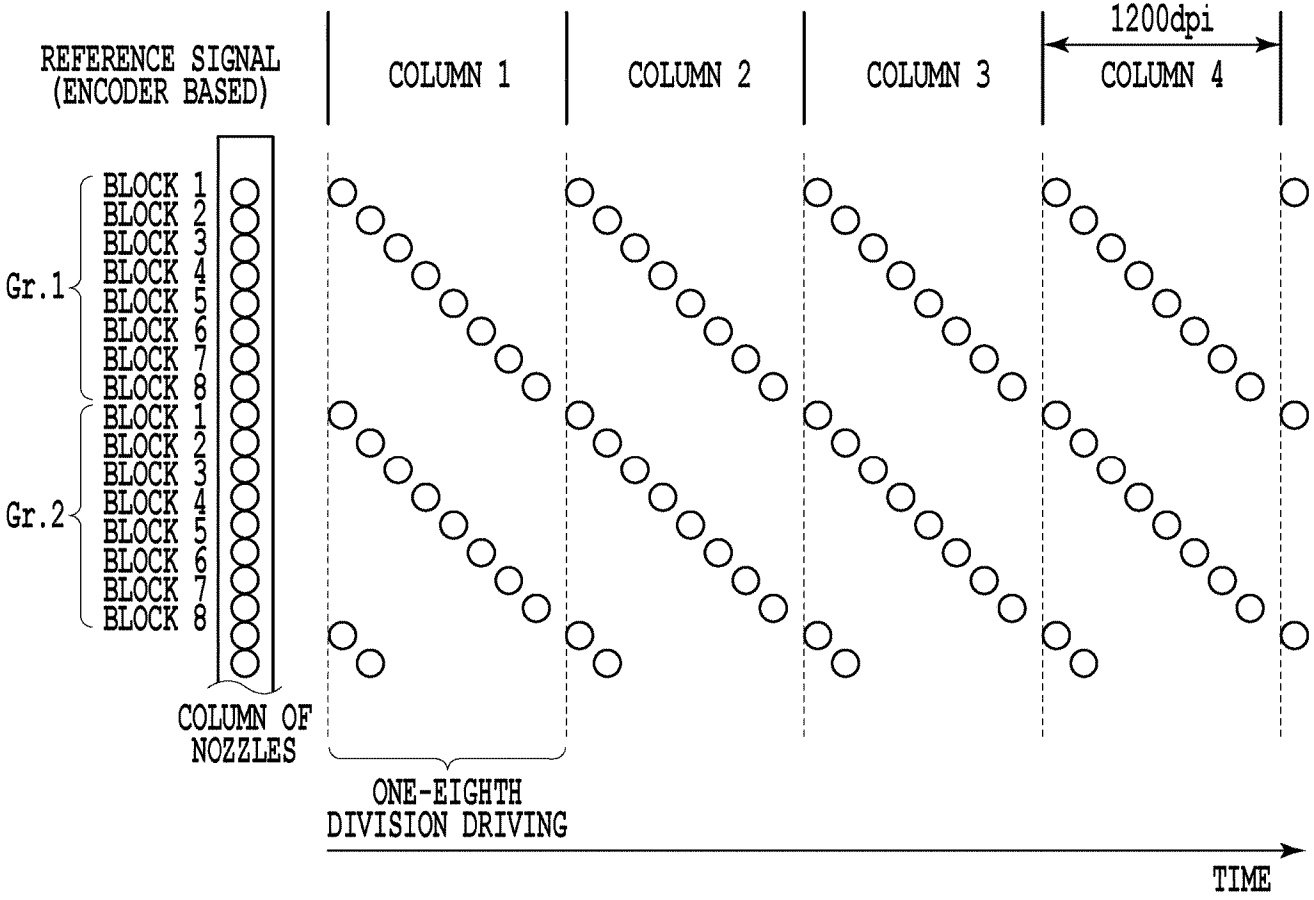
FIG. 5 is a diagram for explaining one-eighth time division driving of a printing head.

FIG. 5 illustrates one-eighth time division driving of a printing head, and illustrates normal time-division driving in the case where there is no fluctuation in the conveying speed of a printing sheet. In FIG. 5, eight nozzles, at consecutive locations in the arrangement of a plurality of nozzles of a column of nozzles, are divided into eight blocks 1 to 8, each having a different ejection (driving) timing. Accordingly, time division driving groups Gr1, Gr2, . . . are formed for every eight nozzles at consecutives locations, and the same sequence drive is performed among these groups.

Note that two columns of nozzles shifted from each other by a half pitch for each ink color illustrated in FIG. 1B are illustrated in one column in FIG. 5. Namely, it is needless to say that the ejection (driving) timing by the distance between two columns of nozzles shifts, but hereinafter the embodiments will be explained as the time division driving of one column of nozzles. For each column, in each group, the nozzles of the block 1→block 2→block 3→block 4→block 5→block 6→block 7→block 8 are sequentially driven, at a predetermined time interval, to eject ink. Accordingly, dots indicated by a circle in FIG. 5 are formed for each column and a line is printed. Note that, it is needless to say that the example illustrated in FIG. 5 is an example of the so-called "solid image" in which print data forms a dot in all the pixels, and in accordance with print data, a dot may not be formed depending on a pixel.

Figure 6:
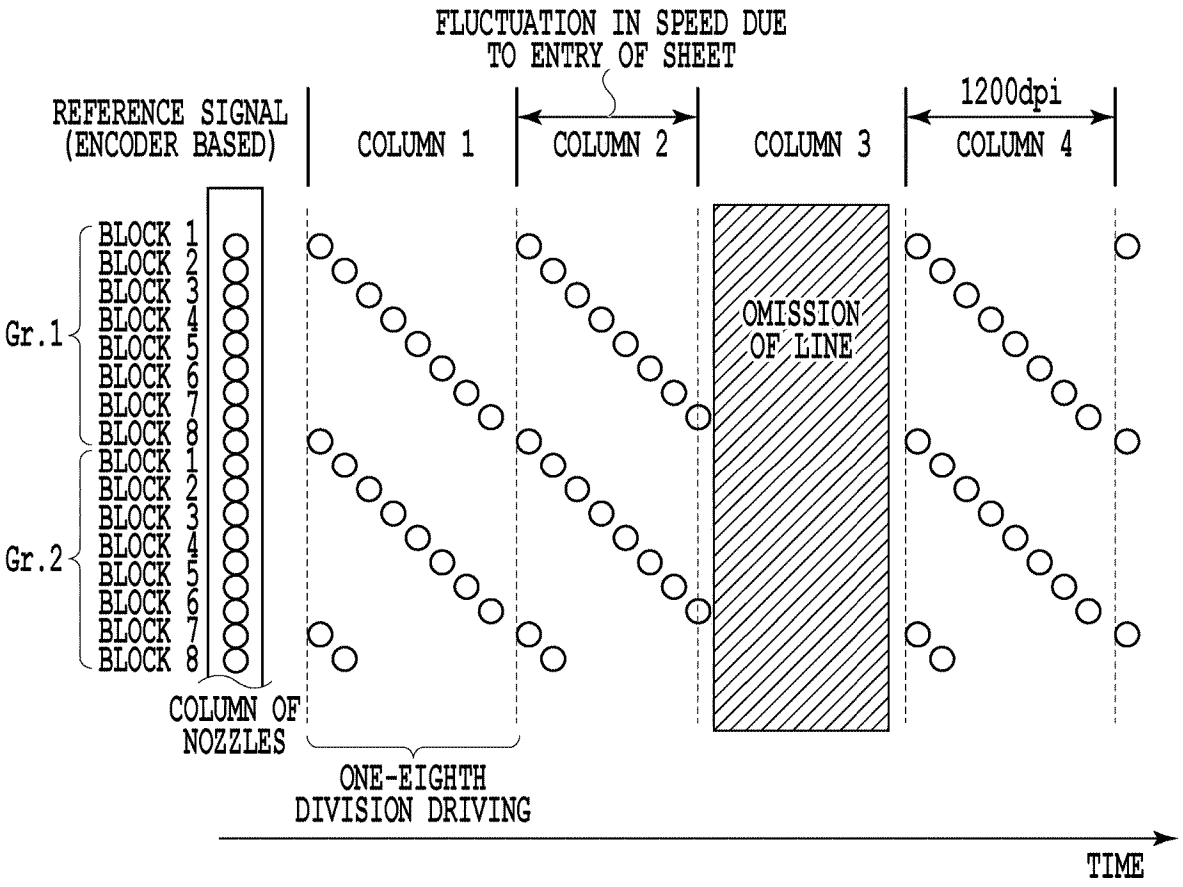
FIG. 6 is a diagram for explaining the time division driving according to a comparative example.

FIG. 6 is a diagram for explaining the time division driving according to a comparative example, and illustrates a case where there is a fluctuation in the conveying speed of a printing medium in one-eighth time division driving. Particularly, there is illustrated the time division driving in the case where, in FIG. 1A, for example, the printing sheet 105 enters between the transfer body 103 and the conveying roller 106 along with the conveying of the sheet, thereby resulting in a fluctuation (increase) in the speed of the transfer body 103.

As illustrated in FIG. 6, in the column 2, the speed of the transfer body 103 becomes faster than a specified speed due to the entry of the printing sheet 105, whereby the time interval of the column 2 becomes shorter than a predetermined interval. Namely, the reference signal of the next column 3 comes earlier than usual, and at this timing, eight blocks of driving (ejection) of the column 2 are still being performed. When such a state is generated, a drive circuit according to the comparative example stops driving the column 3 as error processing resulting from a malfunction. As the result, as illustrated in FIG. 6, the dot of the column 3 cannot be formed and the omission of one line (one column) of printing is generated.

First Embodiment

Figure 7A:
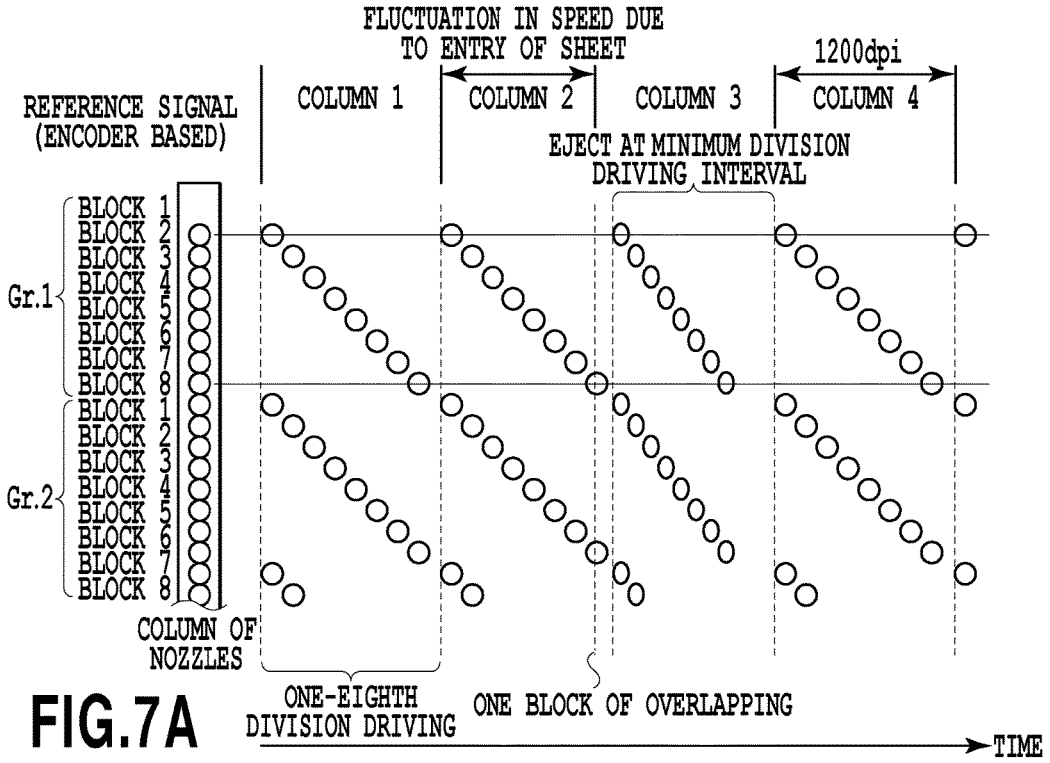
FIG. 7A and FIG. 7B are diagrams for explaining an example of the time division driving according to a first embodiment of the present invention.
Figure 7B:
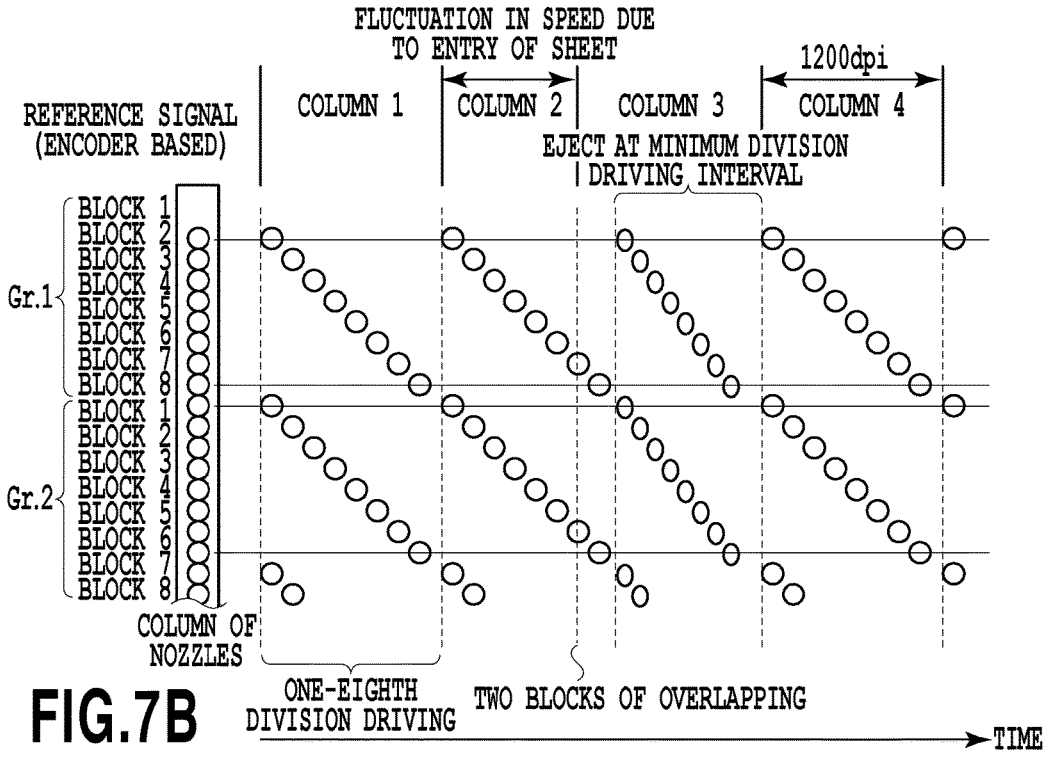

FIG. 7A and FIG. 7B are diagrams for explaining an example of the time division driving according to a first embodiment of the present invention. In the case where the conveying speed of a sheet becomes faster due to the entry of the sheet or the like, in the present embodiment, the drive interval in the time division driving in the next column is switched to the minimum division driving time.

FIG. 7A illustrates an exemplary drive in the case where the next reference signal comes earlier by one block during driving of the column 2. In the next column 3 of the column 2 in which overlapping between the reference signal and the ejection timing occurs, the time division driving interval between the blocks is switched to the minimum driving interval the printing head can allow. Accordingly, after all of the eight blocks of driving in the column 2 are performed, all of the eight blocks of driving can be performed also in the next block 3 in spite of a short time interval.

FIG. 7B illustrates an exemplary drive in the case where the next reference signal comes earlier by two blocks during printing of the column 2. In the next column 3 of the column 2 in which overlapping of the reference signal occurs, as with FIG. 7A, the time division driving interval between the blocks is switched to the minimum driving interval the printing head can allow. Even in the case where the next reference signal comes earlier by two blocks as in this example, all of the eight blocks of driving can be performed in the next column at the minimum driving interval the printing head can allow.

Figure 8:
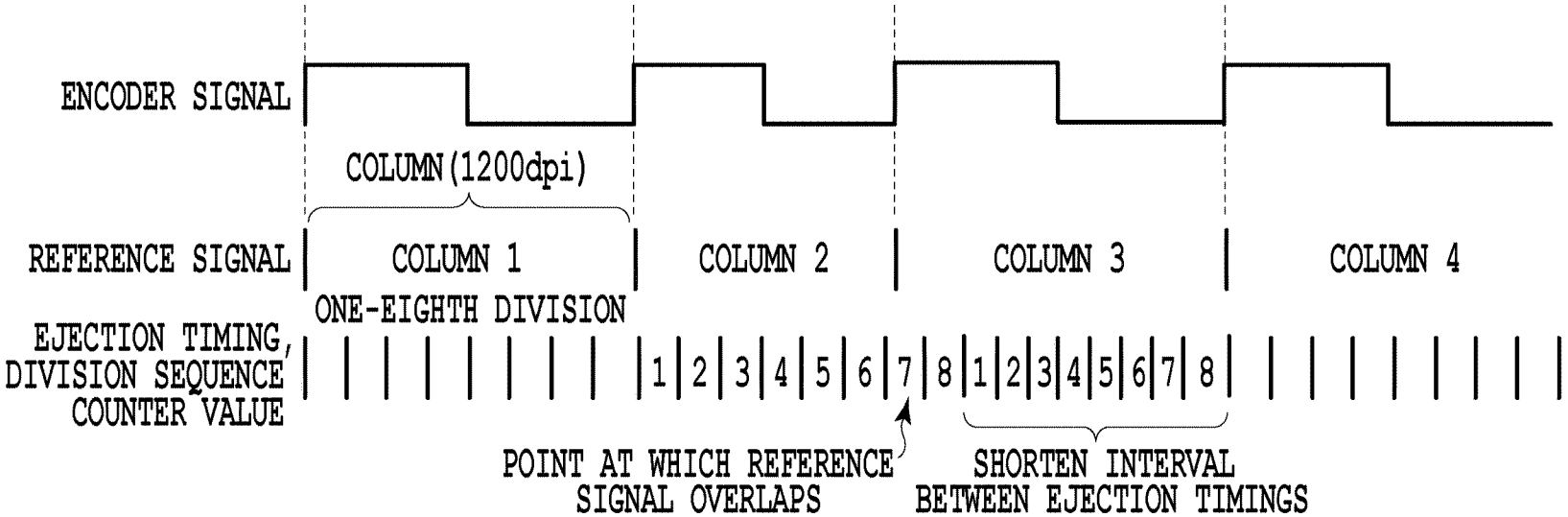
FIG. 8 is a timing chart of each signal generated by a print timing generation unit in the time division driving illustrated in FIG. 7B.

FIG. 8 is a timing chart of each signal generated by the print timing generation unit 208 (ejection timing generation unit 302) in the time division driving illustrated in FIG. 7B. At the seventh block of the ejection timing signal for driving the column 2 in a time-division manner, overlapping (duplication) with the reference signal of the column 3 occurs. As described in detail later in FIG. 9, this overlapping is detected by counting up the number of ejection timing signals output for each column by the ejection timing generation unit 302 (FIG. 3) and by using the counted-up number in the case where the reference signal enters. When the occurrence of the above-described overlapping at the seventh block is detected, the ejection timing generation unit 302 (FIG. 3) outputs the ejection timing signal at the eighth block as it is. Furthermore, the ejection timing signal in the column 3 is output with the reduced interval between the ejection timing signals (at the minimum division driving interval).

Figure 9:
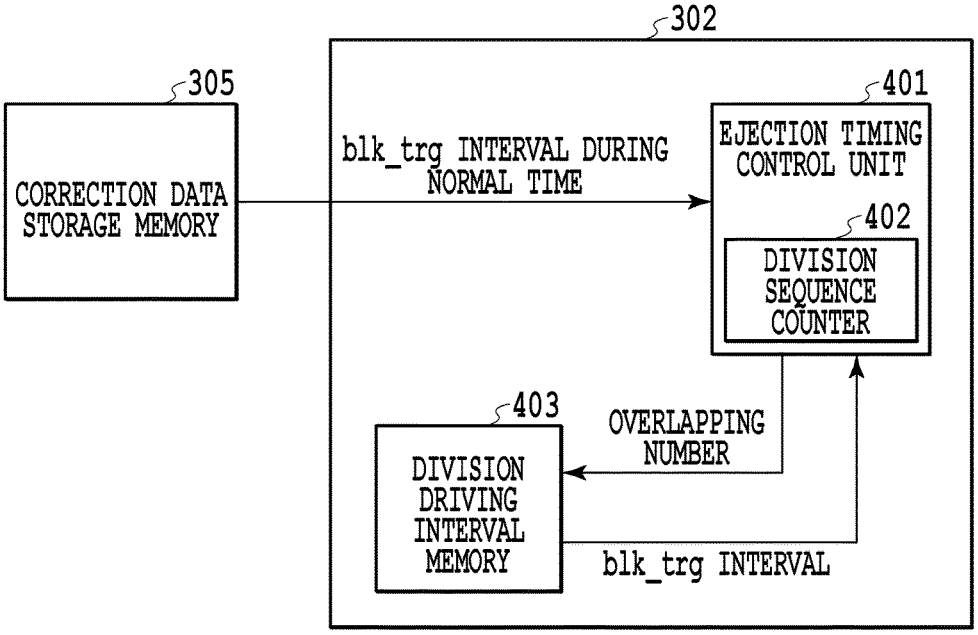
FIG. 9 is a block diagram illustrating the detail of the ejection timing generation unit.

FIG. 9 is a block diagram illustrating the detail of the ejection timing generation unit 302. Note that, in FIG. 9, a division driving interval memory 403 and a signal output from this memory and also input to the memory have a configuration according to a second embodiment described later. An ejection timing control unit 401 of the ejection timing generation unit 302 includes a division sequence counter 402 that indicates which block is currently being driven. In the present embodiment, because of eight blocks of time division driving, an output of the counter value changes, for each driving in each column, in order of 1→2→3→4→5→6→7→8 and the counter repeats the output of the same values thereafter. In the case where there is no overlapping between the ejection timing signal or ejection interval and the reference signal, an encoder-based reference signal (encoder signal) is input in the case where the division sequence counter value is 1. However, for example, in the case where the next reference signal is input one block earlier and the counter value is 8 (FIG. 7A), or in the case where the next reference signal is input two blocks earlier and the counter value is 7 (FIG. 7B), the reference signal is input, respectively. As the result, with the count value, the occurrence of overlapping can be detected and at which block the overlapping is occurring can be detected. In this case, the timing of overlapping and the information (the number of overlapped blocks) indicative of by how many blocks earlier the reference signal came are held in a predetermined memory (not illustrated) inside the ejection timing generation unit 302. When overlapping is detected, the ejection timing control unit 401 drives all of the eight blocks in a column currently being driven, and then switches the driving interval between the blocks to the minimum division driving interval stored in a non-illustrated memory to perform the next eight blocks of driving.

Second Embodiment

Figure 10A:
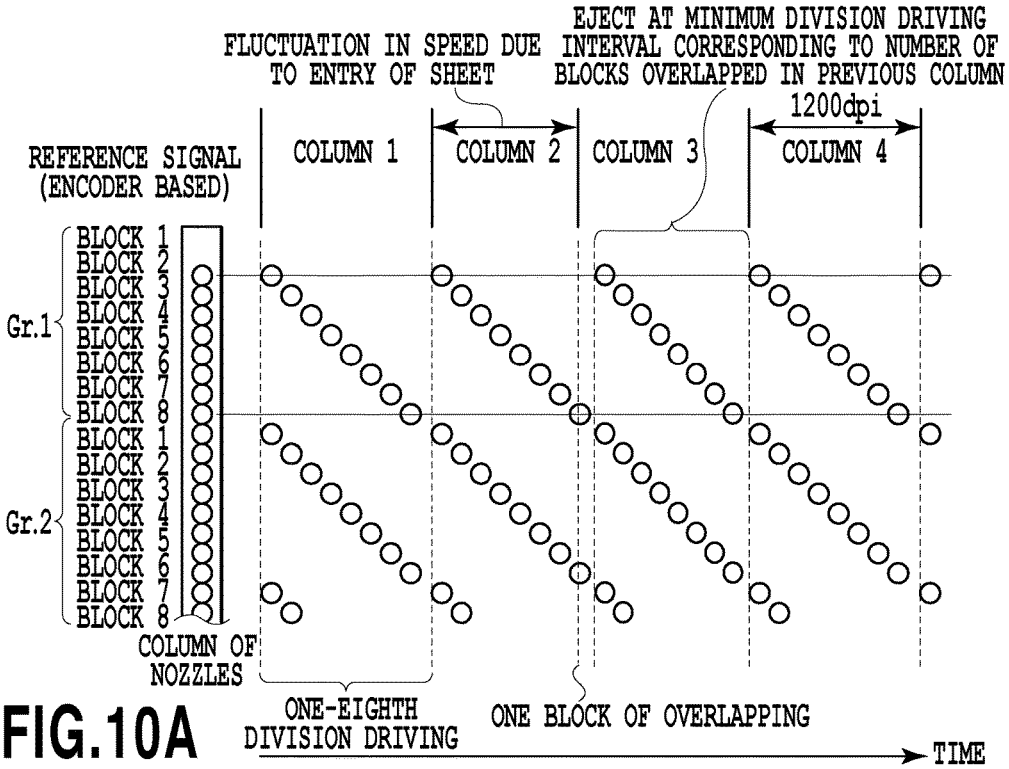
FIG. 10A and FIG. 10B are diagrams for explaining an example of time division driving according to a second embodiment of the present invention.
Figure 10B:
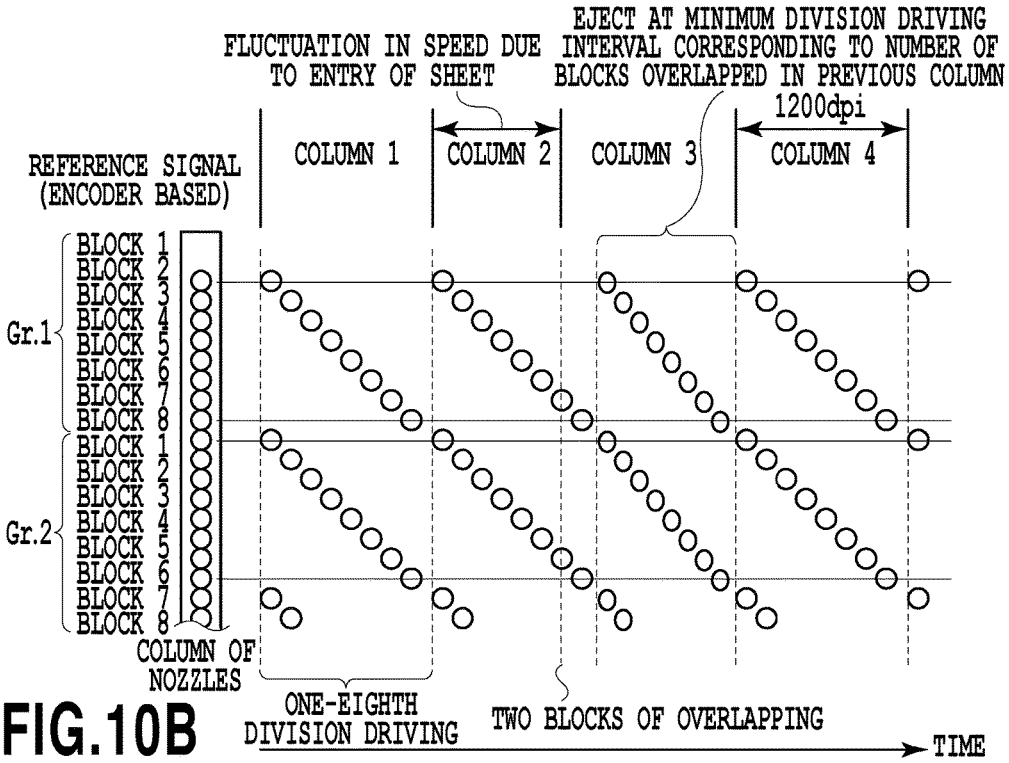

FIG. 10A and FIG. 10B are diagrams for explaining an example of time division driving according to a second embodiment of the present invention. In the above-described first embodiment, in the case where a fluctuation in the speed of a sheet due to the entry of the sheet or the like occurs, the driving interval between the blocks which are to be driven in a time-division manner between the signals serving as the next reference is switched to the minimum driving interval available in the relevant printing head. In contrast, in the second embodiment of the present invention, the time division driving is performed at a driving interval corresponding to at which block the overlapping has occurred.

FIG. 10A illustrates an example in the case where the next reference signal comes earlier by one block during printing of the column 2. In the next column 4 of the column 3 in which overlapping between the reference signal and the ejection timing signal (ejection interval) has occurred, eight blocks of time division driving are performed at a driving interval corresponding to the one block. FIG. 10B illustrates an example in the case where the next reference signal comes earlier by two blocks during printing of the column 2. In the next column of the column in which overlapping has occurred, eight blocks of time division driving are performed at a driving interval corresponding to the two blocks. The driving interval corresponding to the two blocks becomes shorter than the driving interval corresponding to the one block.

As illustrated in FIG. 9, according to the present embodiment, the ejection timing generation unit 302 includes the division driving interval memory 403. FIG. 11 is a diagram for illustrating the contents of the division driving interval memory 403. In the example illustrated in FIG. 11, corresponding to a number (hereinafter, overlapping number) indicative of by how many blocks the reference signal came earlier, the respective values of "division driving interval 1", "division driving interval 2", "division driving interval 3", and "division driving interval (minimum value)" are stored in advance. Here, the "division driving interval (minimum value)" is the shortest (smallest), and the driving interval becomes shorter in order of "division driving interval 3", "division driving interval 2", and "division driving interval 1". The "division driving interval (minimum value)" can be set, e.g., to be the same value as the minimum division driving interval above-described in the first embodiment.

As illustrated in FIG. 11, in overlapping numbers 1 to 3, the driving intervals are set to the "division driving interval 1", "division driving interval 2", and "division driving interval 3" in accordance with the respective numbers. In addition, in the overlapping numbers 4 to 7, the driving interval is set to the fixed "division driving interval (minimum value)". In the case where the overlapping number is large as described above, the driving interval is uniformly switched to the "the division driving interval (minimum value)". Accordingly, the deviation of the driving interval can be reduced, and furthermore, the influence of image quality degradation can be reduced.

Note that, in the present embodiment, for the overlapping numbers 1 to 3, the division driving interval corresponding to the corresponding number is set, whereas for the overlapping numbers 4 to 7, the division driving interval is uniformly set to the "division driving interval (minimum value)", but is not limited to this setting, and the setting can be freely changed in accordance with the characteristic of an individual apparatus.

Figure 12:
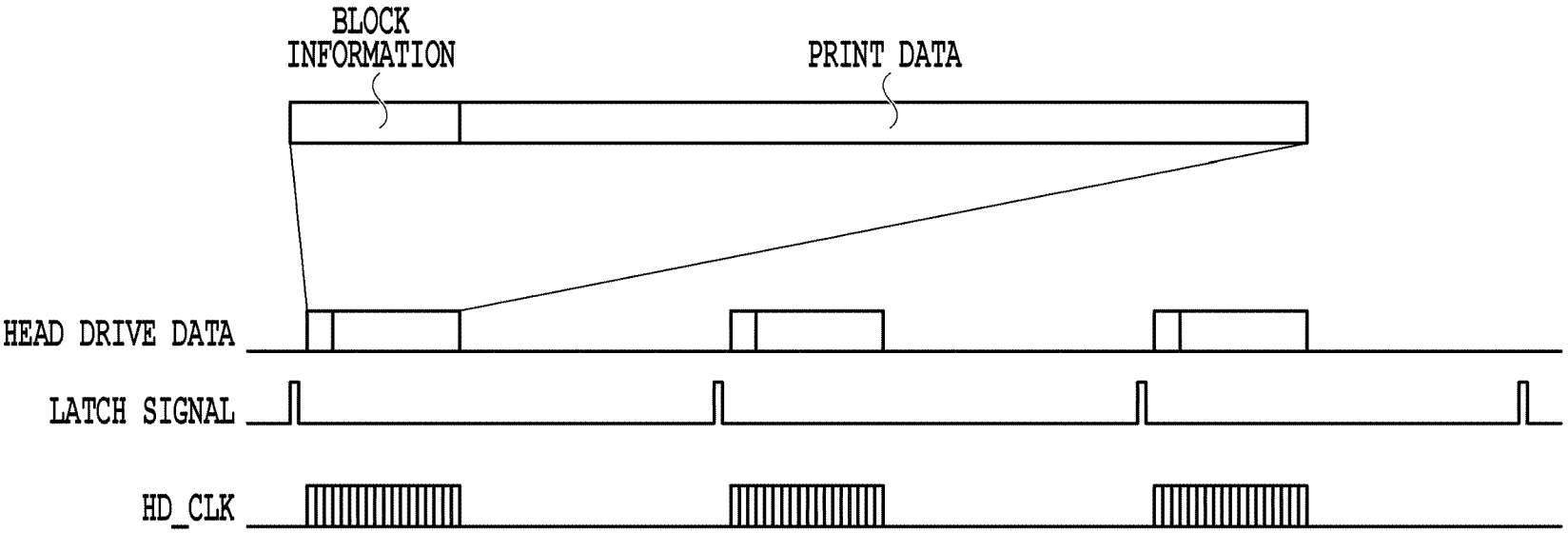
FIG. 12 is a timing chart of head drive data, a latch signal, and a clock signal output and transmitted from a print-data transfer circuit (not illustrated) of a printing control unit.

FIG. 12 is a timing chart of head drive data, a latch signal, and a clock signal, which are output and transmitted from a print-data transfer circuit (not illustrated) of the printing control unit 209 (FIG. 3) in the first and second embodiments. Between the latch signal serving as the timing of ejection and the next latch signal, the drive data including the ejection data for the next ejection and the number of a block to be driven is serially transferred by using a clock HD_CLK.

Figure 13:
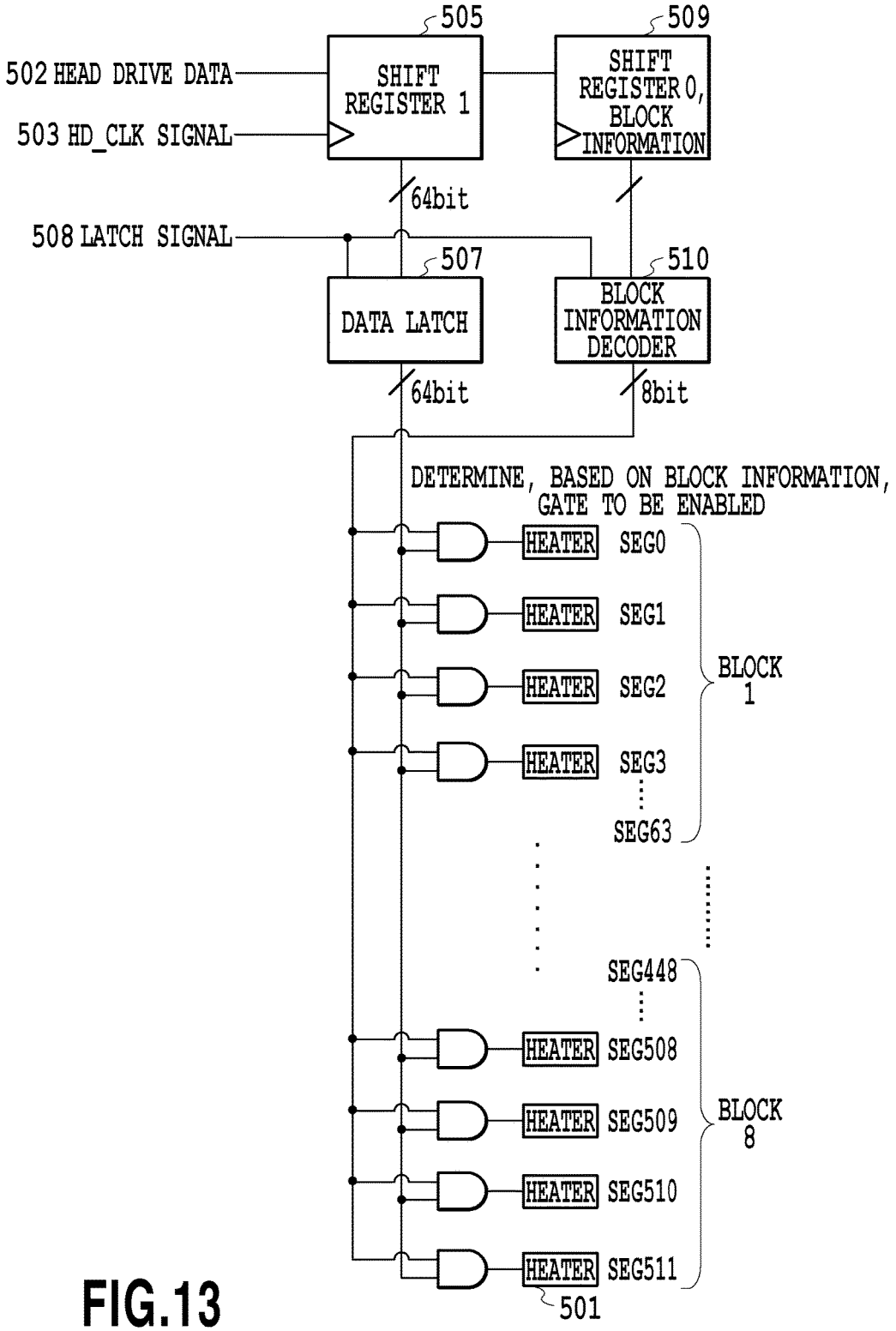
FIG. 13 is a circuit diagram illustrating the drive circuit of a printing head subjected to the time division driving according to the present invention.

FIG. 13 is a circuit diagram illustrating the drive circuit of a printing head subjected to the time division driving of the first and second embodiments. The printing head of the present embodiment is provided with 512 heaters (printing elements) 501 corresponding to 512 nozzles for each ink color. These 512 heaters 501 are divided into eight blocks (one block includes 64 heaters 501), and are driven in a time division manner for each block. Namely, 64 heaters of the same block are simultaneously driven. In FIG. 13, for simplification of illustration and explanation, the number of a heater assigned to each block is designated by SEG0, SEG1, or the like, but the nozzle and heater assigned to each block can be arbitrarily set (e.g., a group of 64 discrete nozzles for every 64 nozzles is assigned to the block 1). Note that, in the present embodiment, a configuration of eight divided blocks is explained, but the division number can be set in accordance with the configuration or the like of a printing head. Head drive data 502 is serially transferred to the printing head 102 by using an HD_CLK signal 503. The drive data 502 including ejection data is input to 64-bit shift registers 505 and 509 by using the HD_CLK signal 503, and then is latched by a 64-bit latch 507 and a block information decoder 510, at the rise of a latch signal 508. In the block information decoder 510, on the basis of the received block information, the latched drive data 502 is expanded to an 8-bit block enable signal, and the heater 501 of a specified block is selected. Only a segment of the heater 501 specified by both the block enable signal expanded by the decoder 510 and the heater print-data signal of the data latch is driven and printing is performed by ejection of ink.

Third Embodiment

Figure 14:
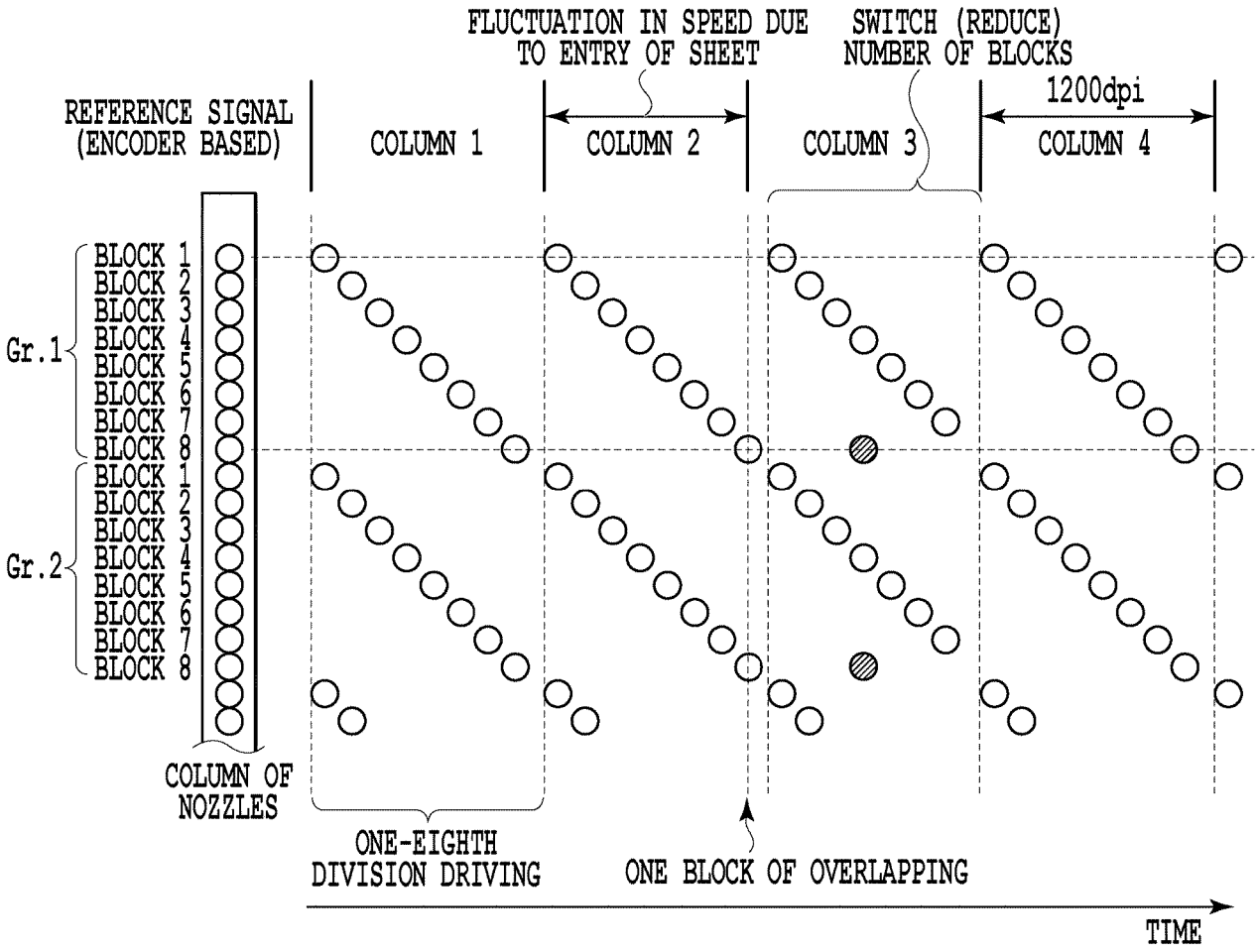
FIG. 14 is a diagram for explaining an example of time division driving according to a third embodiment of the present invention.

FIG. 14 is a diagram for explaining an example of time division driving according to a third embodiment of the present invention. The example of FIG. 14 illustrates the drive control in the case where the next reference signal comes earlier by one block during printing of the column 2. In the case where the next reference signal comes earlier than a predetermined time and overlapping between the reference signal and the ejection timing at the eighth block for ejection (driving) from a nozzle occurs, the drive control of the present embodiment switches the number of blocks involved in the time division driving of the next column 3, from usual eight blocks to seven blocks. Namely, the number of blocks to be driven is reduced from eight blocks to seven blocks. Furthermore, in addition to the nozzle of the block 4 normally scheduled to eject ink at the fourth block of the column 3, the nozzle at the overlapped eighth block is also driven so as to simultaneously eject ink therefrom.

Figure 15:
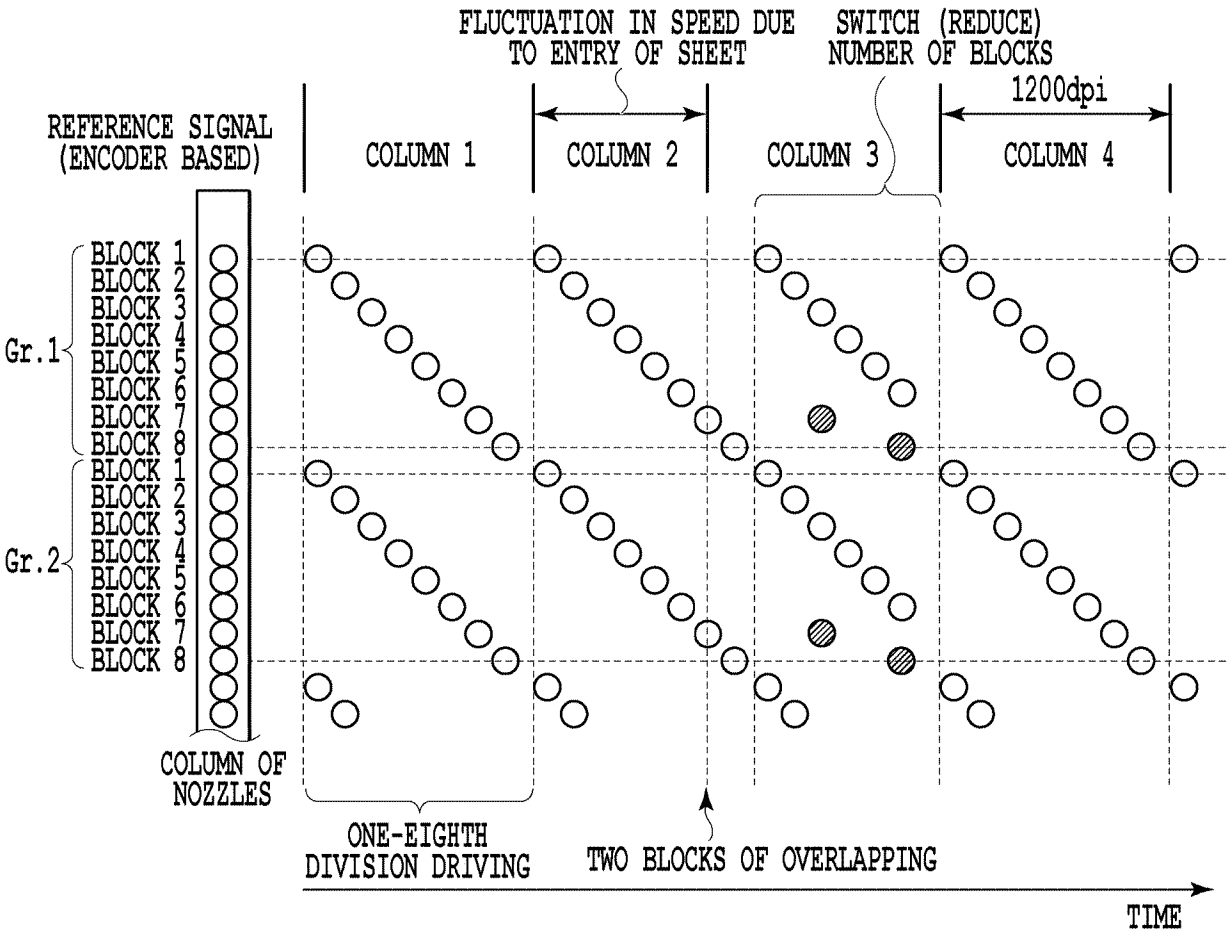
FIG. 15 is a diagram for explaining another example of time division driving according to the third embodiment of the present invention.

FIG. 15 is a diagram for explaining another example of the time division driving according to the third embodiment of the present invention, and illustrates the drive control in the case where the next reference signal comes earlier by two blocks during printing of the column 2. In this example, the number of blocks in the next column 3 of the column 2 in which the overlapping between the reference signal and the ejection timing at the seventh block occurred is switched from the usual eight blocks to six blocks. Namely, the number of blocks to be driven is reduced from eight blocks to six blocks. Then, in addition to the nozzle of the block 3 normally scheduled to eject ink at the third block of the column 3, the nozzle of the block 7 scheduled to eject ink at the seventh block in which overlapping occurred is driven so as to simultaneously eject ink therefrom at the third block. Furthermore, in addition to the nozzle of the block 6 normally scheduled to eject ink at the sixth block of the column 3, the nozzle of the block 8 scheduled to eject ink at the eighth block after the overlapping occurred is driven so as to simultaneously eject ink therefrom at the sixth block. Namely, in this third embodiment, the division number of a block to be driven is reduced in accordance with the degree of overlapping.

To generalize the above-described drive control of FIG. 14 and FIG. 15, in the case where the number of blocks of printing elements to be driven in a time division manner is set to N and the k-th block overlaps with the reference signal, there is performed the control for reducing the number of blocks to be driven next from N blocks by (N−k+1) blocks.

Figure 16:
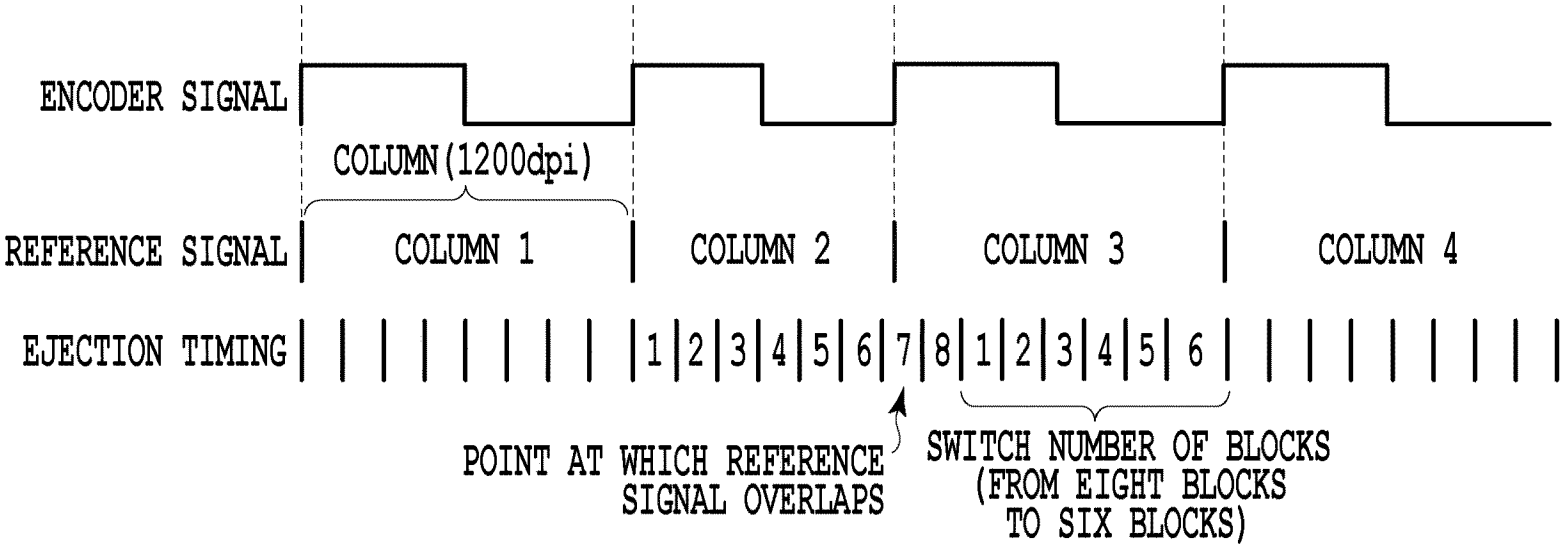
FIG. 16 is a timing chart of each signal generated by the print timing generation unit in the time division driving illustrated in FIG. 15.

FIG. 16 is a timing chart of each signal generated by the print timing generation unit 208 in the time division driving illustrated in FIG. 15. As illustrated in FIG. 16, at the seventh block of the ejection timing signal for driving in a time-division manner the column 2, the overlapping (duplication) with the reference signal of the column 3 occurs. This overlapping is detected by counting up the number of ejection timing signals to be output for each column by the ejection timing generation unit 302 (FIG. 3) and by using the counted-up number in the case where the reference signal is input. In the example illustrated in FIG. 15 and FIG. 16, when an input of the reference signal is detected after the sixth ejection timing signal is output and before the seventh ejection timing signal is output, then the occurrence of the overlapping in the seventh block is detected. Then, in driving the column 3, the ejection timing generation unit 302 (FIG. 3) outputs six blocks of "ejection timing" signals on the basis of the seventh block related to the detected overlapping (FIG. 3). Simultaneously, the ejection timing generation unit 302 outputs a "block switching signal" indicative of the switching of the number of blocks and "6" that is the "number of blocks" after switching (FIG. 3). On the basis of the "ejection timing" signal, "block switching signal", and "number of blocks" which are input from the ejection timing generation unit 302, the printing control unit 209 (FIG. 3) drives a printing head and performs time division driving. Namely, the ejection timing generation unit 302 notifies the printing control unit of the information indicating whether or not there is a reduction in the number of blocks and the information indicative of the number of blocks after reduction, together with the timing signal for driving a block.

Figure 17:
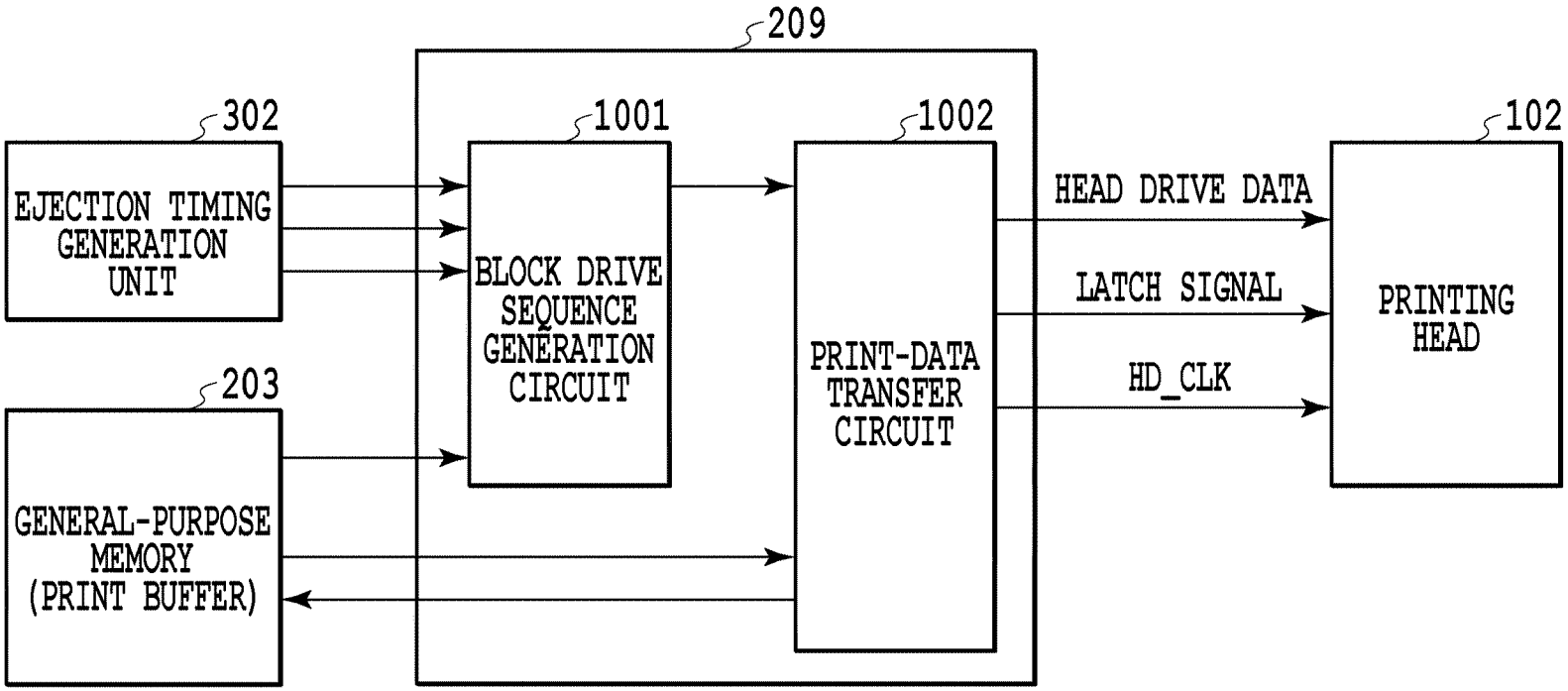
FIG. 17 is a block diagram for explaining the detailed configuration of the printing control unit.

FIG. 17 is a block diagram for explaining the detailed configuration of the printing control unit 209 according to the present embodiment. On the basis of the overlap information indicated by the above-described three signals output from the ejection timing generation unit 302 of the print timing generation unit 208, a block drive sequence generation circuit 1001 of the printing control unit 209 determines the blocks to be simultaneously driven and the drive sequence thereof which are described later in FIG. 18. In addition, a print-data transfer circuit 1002 serially transfers drive data and drive block information to the printing head 102 on the basis of the information about the determined drive sequence and the like.

Figure 18:
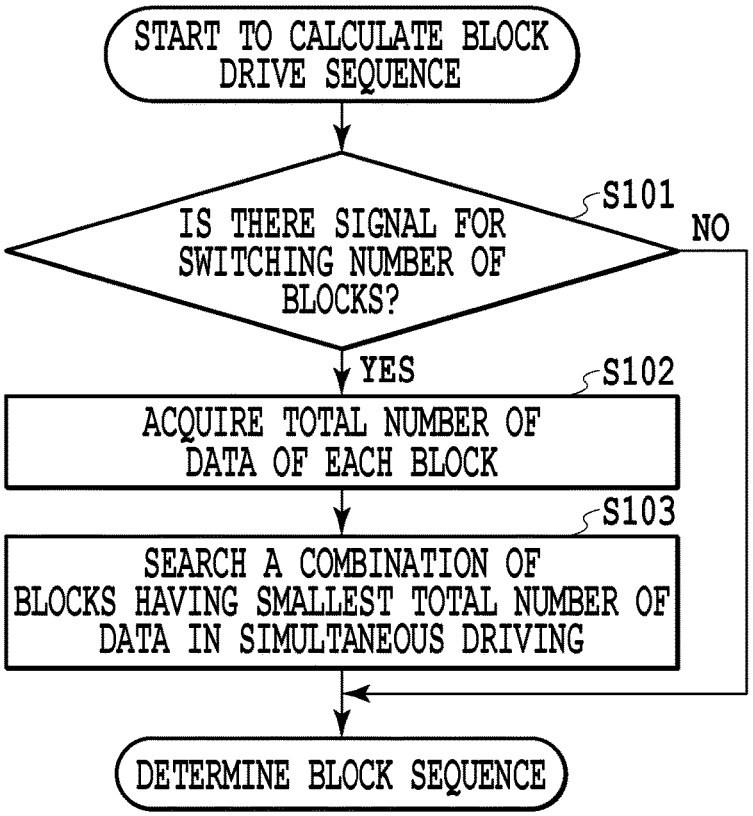
FIG. 18 is a flow chart illustrating block drive sequence determination processing performed in a block drive sequence generation circuit.

FIG. 18 is a flow chart illustrating the block drive sequence determination processing performed by the block drive sequence generation circuit 1001 of the present embodiment. In step S101, it is determined whether or not there is a signal for switching the number of blocks, the signal being transmitted from the ejection timing generation unit 302 of the print timing generation unit 208. In the case where there is no signal, the processing is completed without changing a pre-determined block drive sequence. In the case where there is the signal for switching the number of blocks, in step S102, a total number of cumulative print data (ejection data) of each of the block 1 to block 8 is acquired from the print buffer. Then, in step S103, the drive sequence is determined by searching a combination of blocks having the smallest total number of cumulative data in the case of simultaneous driving. Accordingly, an increase in power in simultaneously driving a plurality of blocks can be suppressed. In the example illustrated in FIG. 14, the nozzles of the block 4 and block 8 are simultaneously driven, while in the example illustrated in FIG. 15, the nozzles of the block 3 and block 7 and the nozzles of the block 6 and block 8 are simultaneously driven, respectively.

Figure 19A:
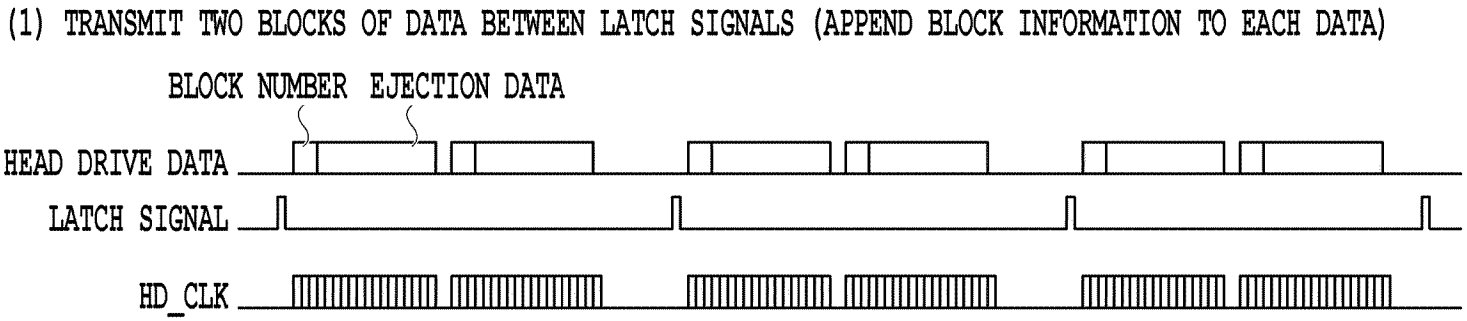
FIG. 19A and FIG. 19B are timing charts of head drive data, a latch signal, and a clock signal output and transmitted from the print-data transfer circuit.
Figure 19B:
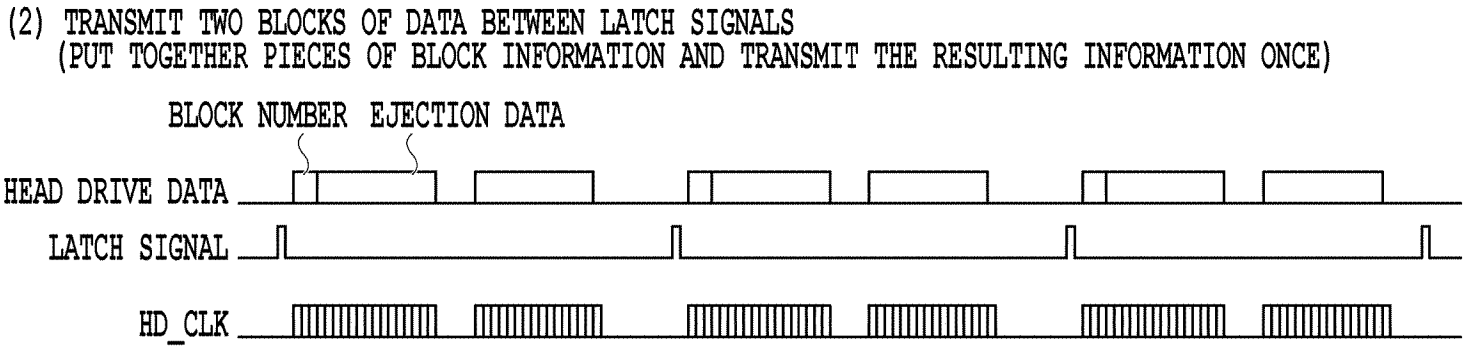

FIG. 19A and FIG. 19B are timing charts of head drive data, a latch signal, and a clock signal, which are output and transmitted from the print-data transfer circuit 1002 illustrated in FIG. 17, and illustrate two forms of signal transmission, respectively.

Between the latch signal serving as the timing of ejection and the next latch signal, drive data including the ejection data for the next ejection and the number of a block to be driven are serially transferred by using a clock HD_CLK. In consideration of driving at most two blocks within one latch interval (between latches), two types of block numbers and ejection data are allowed to be transmitted between latch signals. The transmission form illustrated in FIG. 19A is a form in which the information about the block number is appended to each ejection data, whereas the transmission form illustrated in FIG. 19B is a form in which the pieces of information about the block number are collectively appended to one ejection data. Note that, in the transmission form illustrated in FIG. 19A, in the case where there is no fluctuation in speed of the printing medium and there is no change in the number of blocks to be driven, a valid block number may be transmitted only for the first data of two types of block numbers, while null data may be transmitted for the second data thereof.

Figure 20:
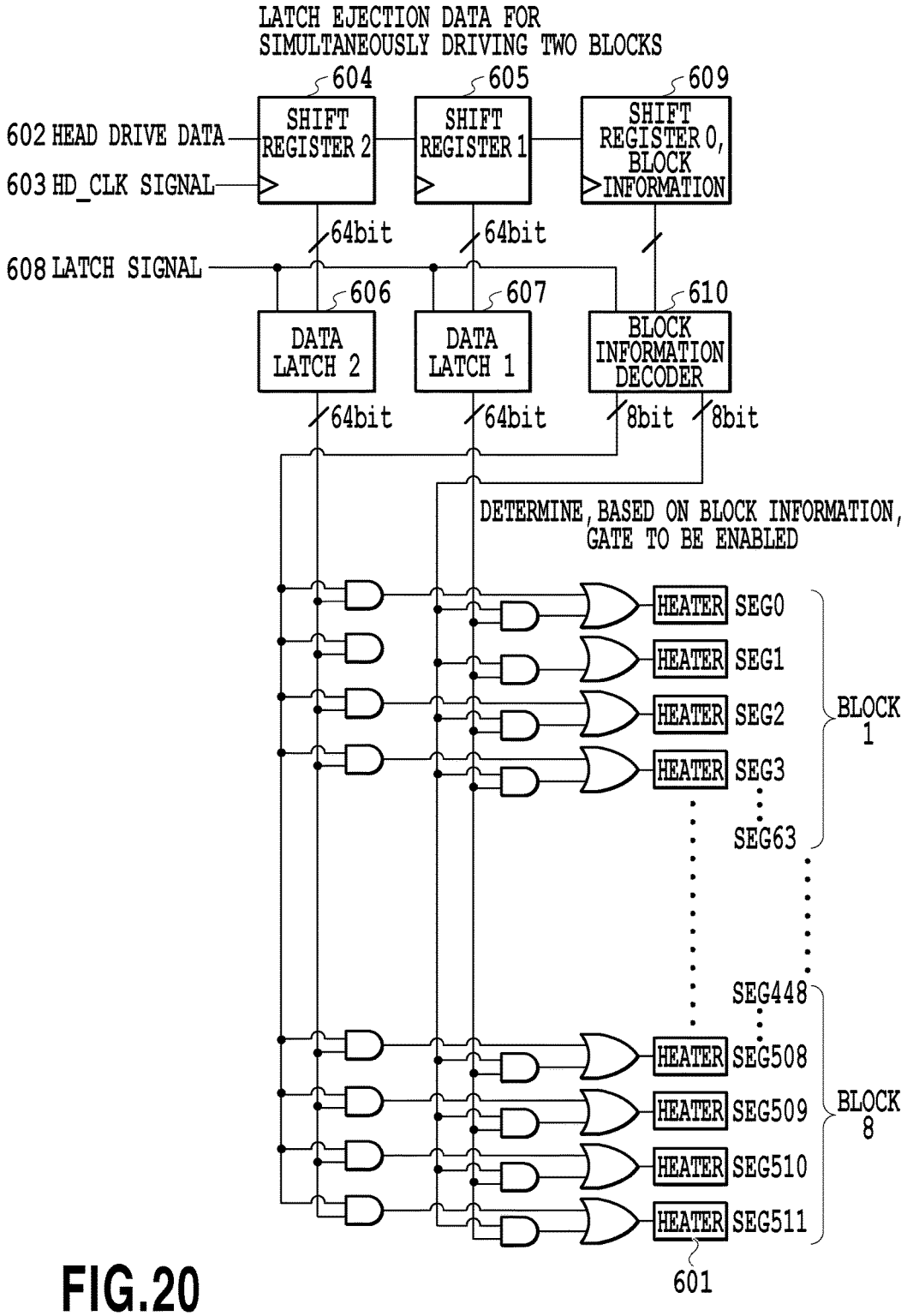
FIG. 20 is a circuit diagram illustrating the drive circuit of a printing head subjected to the time division driving according to the present invention.

FIG. 20 is a circuit diagram illustrating the drive circuit of a printing head subjected to the time division driving of a third embodiment. The printing head of the present embodiment includes 512 heaters (printing elements) 601 corresponding to 512 nozzles for each ink color. These 512 heaters 601 are divided into eight blocks (one block includes 64 heaters 601), and are driven in a time division manner for each block. Namely, 64 heaters 601 of the same block are simultaneously driven. In FIG. 20, for simplification of illustration and explanation, the number of the heater 601 assigned to each block is designated by SEG0, SEG1, or the like, but the nozzle and heater assigned to each block can be arbitrarily set (e.g., a group of 64 discrete nozzles for every 64 nozzles is assigned to the block 1). Note that, in the present embodiment, a configuration of eight divided blocks is explained, but the division number can be set in accordance with the configuration or the like of a printing head. Head drive data 602 is serially transferred to the printing head 102 by using an HD_CLK signal 603. The drive data 602 including ejection data is input to 64-bit shift registers 604, 605, and 609 by using an HD_CLK signal 603, and then is latched by 64-bit latches 606, 607 and a block information decoder 610, at the rise of a latch signal 608. In the block information decoder 610, on the basis of the received block information, the latched drive data 602 is expanded to an 8-bit block enable signal, and the heater 601 of a specified block is selected. Only a segment of the heater 601 specified by both the block enable signal expanded by the decoder 610 and the heater print-data signals of the data latches 1, 2 is driven and printing is performed by ejection of ink.

The drive circuit of the present embodiment is capable of driving, as described above in FIG. 14, FIG. 15, FIG. 19A, FIG. 19B and the like, the heaters of at most two blocks between a latch signal and the next latch signal. The configuration for this purpose includes, as illustrated in FIG. 13, a shift register 1, a data latch 1, an AND circuit corresponding thereto, etc., and a shift register 2, a data latch 2, an AND circuit corresponding thereto, etc.

Next, time division driving according to a fourth embodiment, a fifth embodiment, and a sixth embodiment executed by the printing apparatus according to the present invention will be explained. In these three embodiments, in the drive control of a printing head, the information (head temperature) about the printing head is acquired for each reference signal in time division driving. Namely, the printing apparatuses which perform the time division driving according to the fourth embodiment, fifth embodiment, and sixth embodiment differ from the basic configuration of the printing apparatuses which perform the time division driving according to the first embodiment, second embodiment, and third embodiment, in that they are provided with a diode sensor (not illustrated).

Specifically, in the printing unit 101, each of the printing heads 102*a*, 102*b*, 102*c*, 102*d*, 102*e*, 102*f*, and 102*g* is provided with a diode sensor (not illustrated) for detecting the temperature of each of the printing heads. Note that the number of diode sensors for the printing head is not limited to this number, but can be determined in accordance with the accuracy of the temperature to be detected. The temperature information about a printing head by this sensor is acquired (head information is acquired) for each reference signal in the time-division driving control of a printing head as described later in FIG. 21 etc. Then, in accordance with this acquired head temperature information, the pulse width in driving the heater for each nozzle by using a voltage pulse is set. Accordingly, a fluctuation in the amount of an ink droplet ejected for each nozzle is suppressed.

Moreover, the printing control unit 209 outputs, together with an output of print data, the pulse width information set on the basis of the head temperature information acquired by the diode sensor, to the printing head 210.

Figure 21:
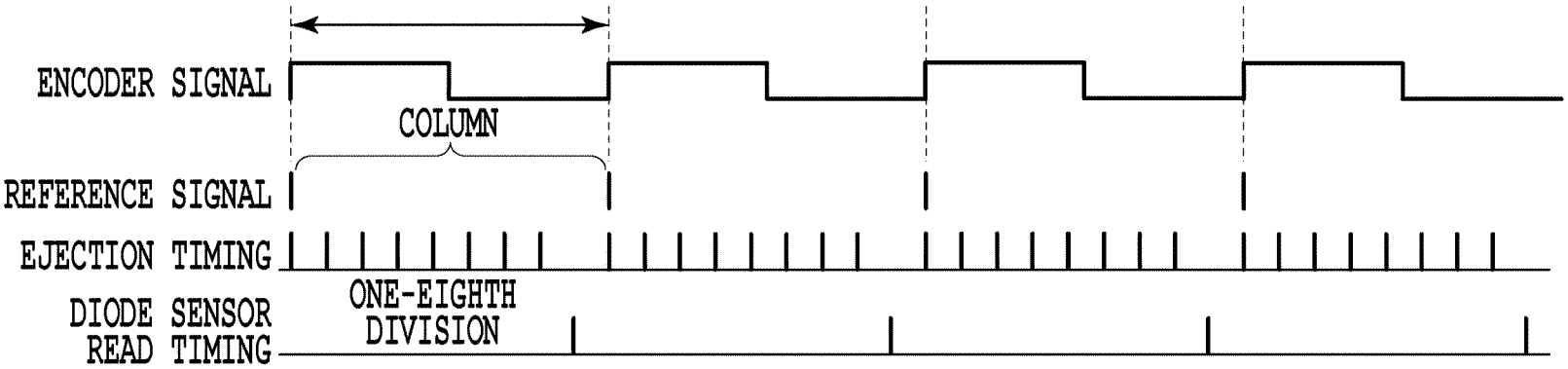
FIG. 21 is a timing chart for explaining an example of the print timing generated by an ejection timing generation unit.

FIG. 21 is a timing chart for explaining an example of the ejection timing generated by the ejection timing generation unit 302, and illustrates eight blocks of ejection timing in time division driving. The example illustrated in FIG. 21 illustrates the ejection timing during normal time in which there is no fluctuation in the conveying speed of a printing medium. In generating the ejection timing, the reference signal is generated on the basis of the encoder signal from the encoder sensor 109, as in the above-described first embodiment, etc. Then, between this reference signal and the next reference signal (within one column of time interval), an ejection timing signal of each of eight drive blocks formed by dividing by eight the nozzles arranged in the main-scanning direction illustrated in FIG. 1B and a read timing signal of a diode sensor are output. In this timing output configuration, a time interval required for each processing is specified, with the ejection timing signal and the read timing signal of a diode sensor as a starting point, and this time interval is set so as to fall within the interval before the next reference signal. Note that, as described above, the ejection timing is generated in accordance with a corrected location indicated by the ejection timing signal information inside the correction data storage memory 305. Note that FIG. 21 illustrates an example of applying the present invention to one-eighth time division driving, but it is apparent from the description of this specification that the application of the present invention is not limited to this division number.

Figure 22:
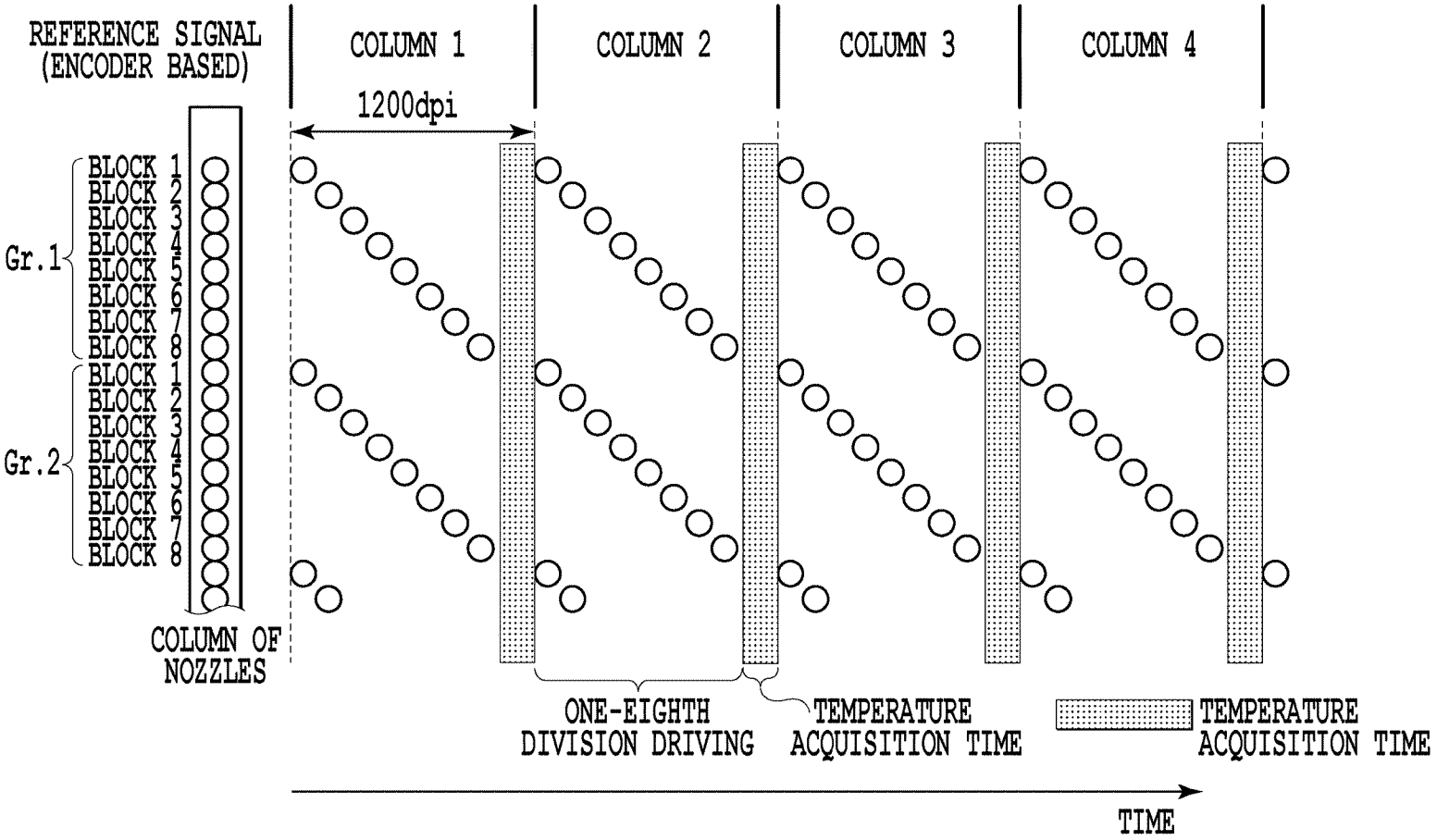
FIG. 22 is a diagram for explaining one-eighth time division driving of a printing head provided with a diode sensor.

FIG. 22 is a diagram for explaining one-eighth time division driving of a printing head provided with a diode sensor, and illustrates normal time-division driving in the case where there is no fluctuation in the conveying speed of a printing sheet. Note that eight nozzles at consecutive locations in the arrangement of a plurality of nozzles of a column of nozzles are divided into eight blocks 1 to 8 each having a different ejection (driving) timing. Accordingly, time division driving groups Gr1, Gr2, . . . are formed for every eight nozzles at consecutives locations, and the same sequence drive is performed among these groups.

Note that two columns of nozzles shifted from each other by a half pitch for each ink color illustrated in FIG. 1B are illustrated in one column in FIG. 22. Namely, it is needless to say that the ejection (driving) timing shifts by the distance between the above two columns of nozzles, but hereinafter, the embodiment will be explained as the time division driving of one column of nozzles. In each of the columns 1, 2, 3, . . . 4 specified by consecutive two reference signals, the nozzles of the block 1→block 2→block 3→block 4→block 5→block 6→block 7→block 8 in each group are sequentially driven at a predetermined time interval, to eject ink. Then, after ejection from these eight blocks of nozzles, temperature acquisition with a predetermined time interval is performed. Accordingly, simultaneous execution of the ink ejection and temperature acquisition from a nozzle can be avoided, and thus for example, the detected temperature information is prevented from becoming inaccurate due to noise generated along with ink ejection.

As described above, dots indicated by a circle in FIG. 22 are formed for each column to print a line, and at the same time temperature acquisition with a diode sensor is performed. Note that, it is needless to say that the example illustrated in FIG. 22 is an example of the so-called "solid image" in which print data forms a dot in all the pixels, and in accordance with print data, a dot may not be formed depending on a pixel.

Figure 23:
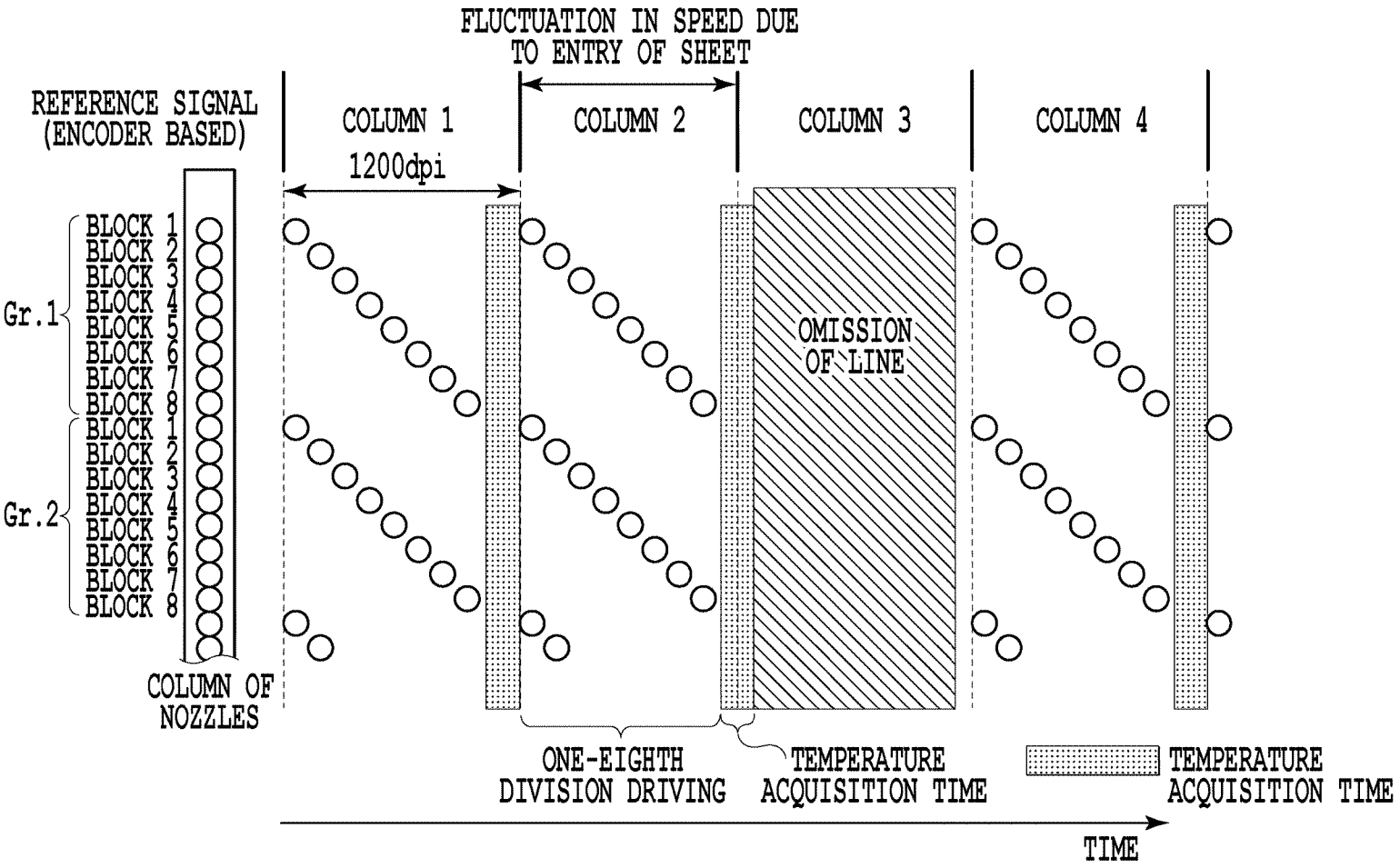
FIG. 23 is a diagram for explaining the time division driving according to a comparative example.

FIG. 23 is a diagram for explaining the time division driving according to a comparative example, and illustrates a case where there is a fluctuation in the conveying speed of a printing medium in one-eighth time division driving. Particularly, there is illustrated the time division driving in the case where, in FIG. 1A, for example, the printing sheet 105 enters between the transfer body 103 and the conveying roller 106 along with the conveying of the sheet, thereby resulting in a fluctuation (increase) in the speed of the transfer body 103.

As illustrated in FIG. 23, in the column 2, the speed of the transfer body 103 becomes faster than a specified speed due to the entry of the printing sheet 105, whereby the time interval of the column 2 becomes shorter than a predetermined interval. Namely, the reference signal of the next column 3 comes earlier than usual, and at this timing, temperature acquisition of the column 2 is still being performed. Namely, a state is generated in which the reference signal having come earlier overlaps with the temperature acquisition time. When such a state is generated, a drive circuit according to the comparative example stops driving the column 3 as error processing resulting from a malfunction. As the result, as illustrated in FIG. 23, the dot of the column 3 cannot be formed and the omission of one line (one column) of printing is generated.

Fourth Embodiment

Figure 24:
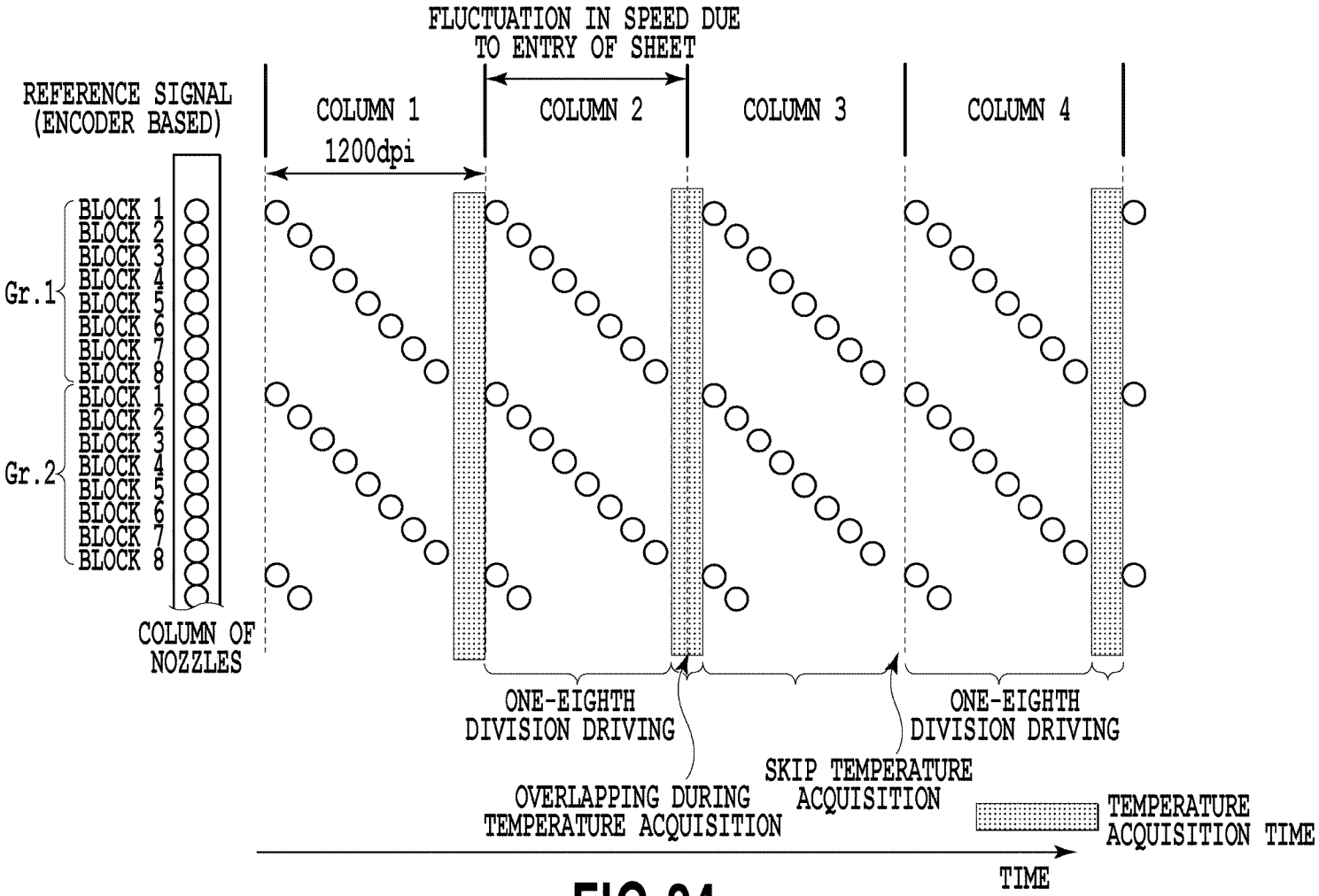
FIG. 24 is a diagram for explaining an example of time division driving according to a fourth embodiment of the present invention.

FIG. 24 is a diagram for explaining an example of time division driving according to a fourth embodiment of the present invention. The example illustrated in FIG. 24 illustrates drive control in the case where the next reference signal comes during the temperature acquisition time after eight blocks of ejection in the column 2 are completed.

In the present embodiment, in the case where a reference signal is detected for each column, then counting is performed for the time period obtained by Formula 1, and the next reference signal is detected within this time period, it is determined that the overlapping between the reference signal and the temperature acquisition time occurred.

$$\text{Count time period} = \text{time needed for one ejection timing} \times \text{number of ejection timing signals to be output} + \text{temperature acquisition time} \quad \text{(Formula 1)}$$

Then, in the case where the next reference signal comes earlier than a predetermined time and the overlapping between the reference signal and the temperature acquisition time occurs, the drive control of the present embodiment skips (disables) the temperature acquisition to be performed in the next column 3. Specifically, the overlapped temperature acquisition is performed as it is, and after the end of this time period, eight blocks of ejection to be performed in the column 3 are started with the end of this time period as a trigger. Namely, the temperature acquisition of the column 3 is skipped, and thus the time interval of the column 3 shortened by the overlapped temperature acquisition time is compensated for with this time period of skipping the temperature acquisition of the column 3, and eight blocks of ejection can be performed during the time interval between the overlapped reference signal and the next reference signal.

Note that, in the case where the temperature acquisition is skipped, control to be performed on the basis of the temperature acquisition is performed using, for example, the temperature acquired at a timing before skipping.

Figure 25:
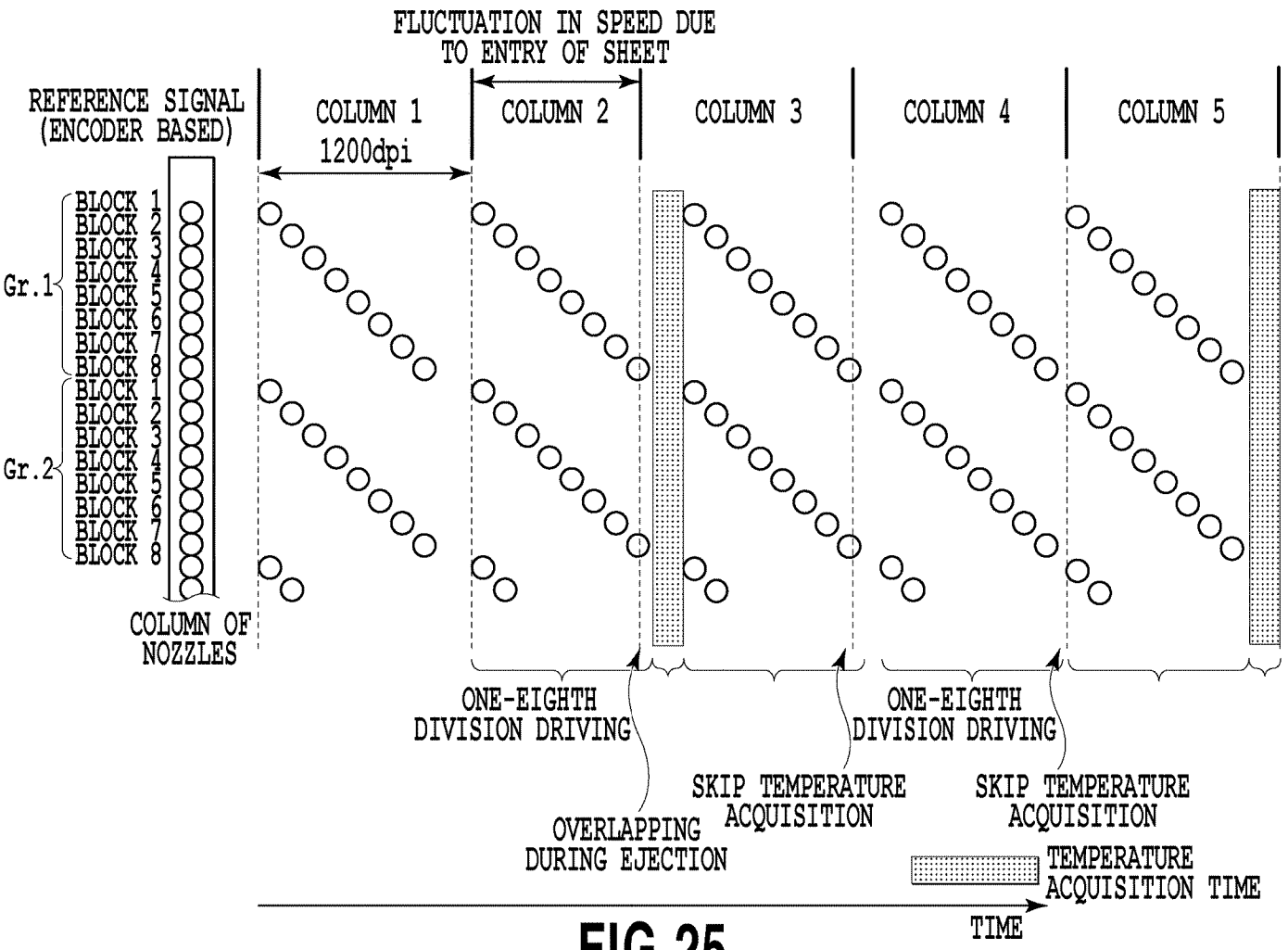
FIG. 25 is a diagram for explaining another example of the time division driving according to the fourth embodiment of the present invention.

FIG. 25 is a diagram for explaining another example of the time division driving according to the fourth embodiment of the present invention, and illustrates the drive control in the case where the next reference signal comes earlier by "one block+temperature time period" during printing of not only the column 2 but also the column 3. In other words, FIG. 25 illustrates the case where the next reference signal is detected during counting the count time period obtained by Formula 1 also in both the column 2 and the column 3. In this example, the overlapped block is driven as it is, and then the temperature acquisition to be performed in this column is performed. Then, after the end of the temperature acquisition, eight blocks of ejection to be performed in the column 3 are performed with the end of the temperature acquisition as a trigger and the temperature acquisition to be performed in the column 3 is skipped. Furthermore, also in the column 4, eight blocks of ejection to be performed are performed and the temperature acquisition to be performed in the column 4 is skipped. As described above, in this example, the temperature acquisition to be performed in two columns: the next column 3 of the column 2 in which overlapping occurred; and the further next column 4, is skipped.

Note that the example illustrated in FIG. 25 is an example in which the reference signal arrives earlier by one block, but is not limited thereto and in the case where the reference signal comes in any block in the middle of driving eight blocks and the overlapping with the ejection timing signal occurs, the above-described drive control is performed. In this case, the temperature acquisition to be skipped is not limited to the above-described two columns, but is determined in accordance with the magnitude of the time interval of actual temperature acquisition or the interval between the reference signals.

Figure 26:
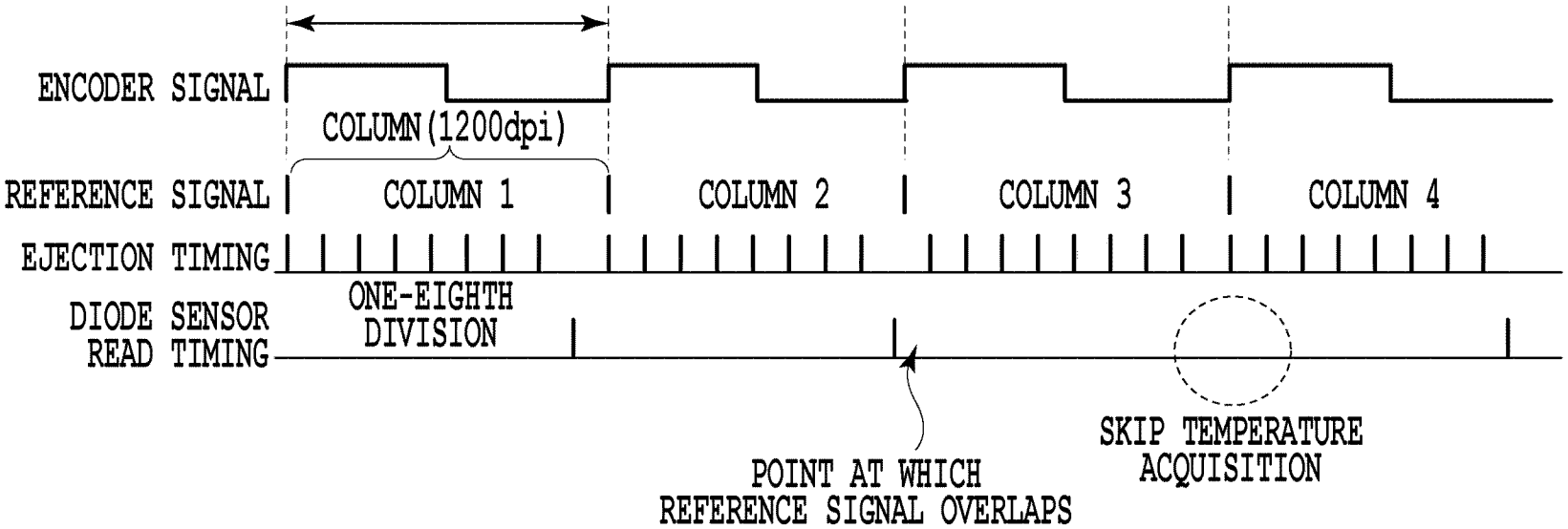
FIG. 26 is a timing chart of each signal generated by the print timing generation unit in the time division driving illustrated in FIG. 24.

FIG. 26 is a timing chart of each signal generated by the print timing generation unit 208 in the time division driving illustrated in FIG. 24. As illustrated in FIG. 26, overlapping (duplication) occurs between the temperature acquisition time after completing the eighth block of the ejection timing signal for driving, in a time-division manner, the column 2 and the reference signal of the next column 3. In response to this, the print timing generation unit 208 prevents the timing signal for the temperature acquisition to be performed in the column 3 from being output.

Fifth Embodiment

Figure 27:
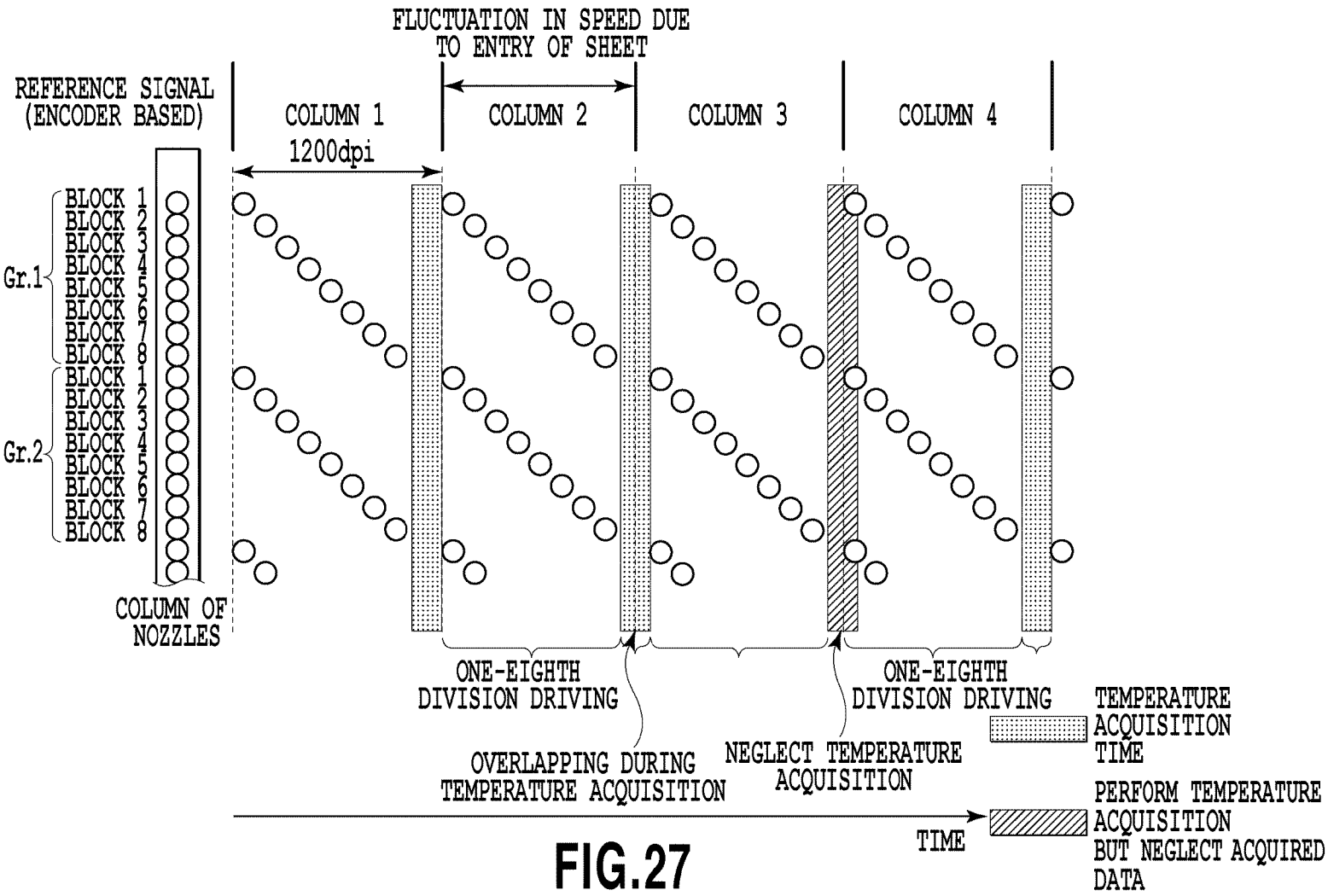
FIG. 27 is a diagram for explaining an example of the time division driving according to a fifth embodiment of the present invention.

FIG. 27 is a diagram for explaining an example of the time division driving according to a fifth embodiment of the present invention. In the present embodiment, temperature acquisition is not skipped as in the fourth embodiment, but processing for performing temperature acquisition but neglecting the acquired temperature (invalidation processing) is performed. The example illustrated in FIG. 27 illustrates the case where the next reference signal comes during the temperature acquisition time interval of the column 2, as with the example illustrated in FIG. 24. In the next column (column 3) in which the overlapping with the reference signal occurred, temperature acquisition is performed as in the normal case. At the same time, ejection driving of the column 4 is started with reference to the overlapped reference signal. As the result, although the temperature acquisition and the ejection driving overlap with each other, the control of neglecting the acquired temperature is performed. This is because the temperature information acquired at the same timing as the ejection driving results in information with low reliability due to the influence of noise etc. Accordingly, also in both of the columns 3 and 4, ejection driving can be performed at the normal ejection-timing and the omission of a dot can be prevented. Note that, although the example illustrated in FIG. 27 is an example of neglecting the temperature acquisition of the column 3, there may be performed the control for starting ejection from the reference signal of the timing at which overlapping occurred and neglecting the acquisition temperature of the column 2.

Figure 28:
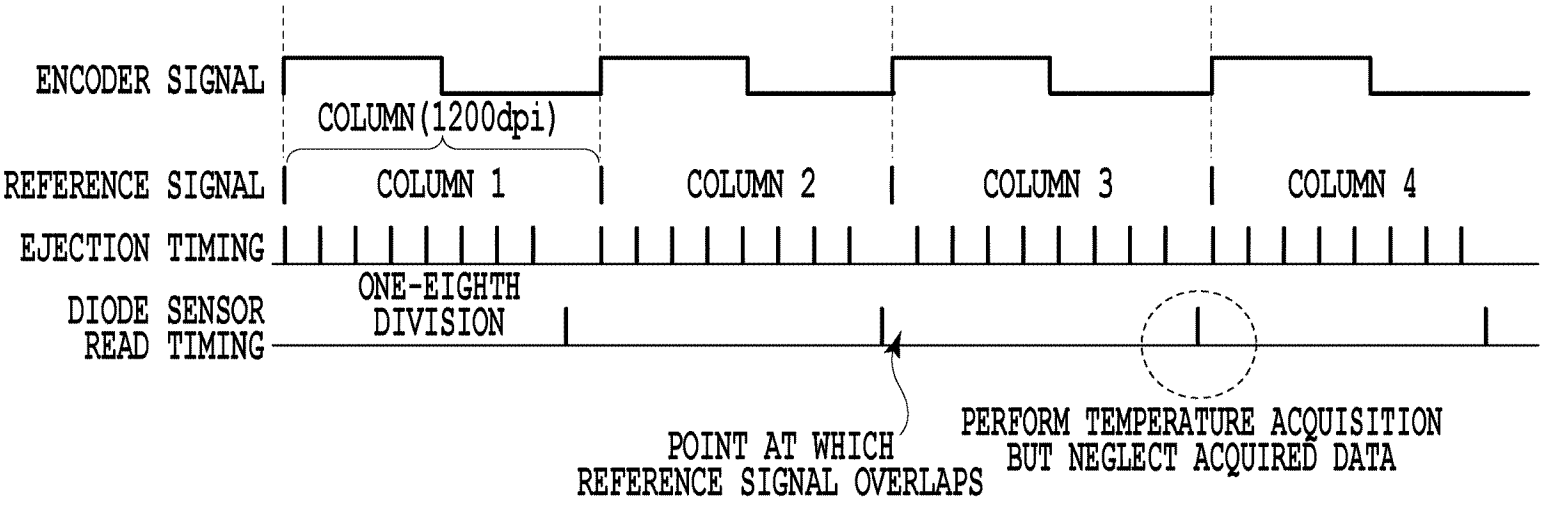
FIG. 28 is a timing chart of each signal generated by the print timing generation unit in the time division driving illustrated in FIG. 27.

FIG. 28 is the timing chart of each signal generated by the print timing generation unit 208 in the time division driving illustrated in FIG. 27. As illustrated in FIG. 27, in the present embodiment, in the case where the reference signal enters in the middle of the temperature acquisition of the column 2 to cause overlapping, a read signal for acquiring the temperature in the next column 3 is output. However, the acquired temperature by this is neglected.

Note that it is obvious from the above-described explanation that this example can also be applied to the case where the reference signal overlaps with the ejection timing, as, for example, in the example illustrated in FIG. 25.

Sixth Embodiment

Figure 29:
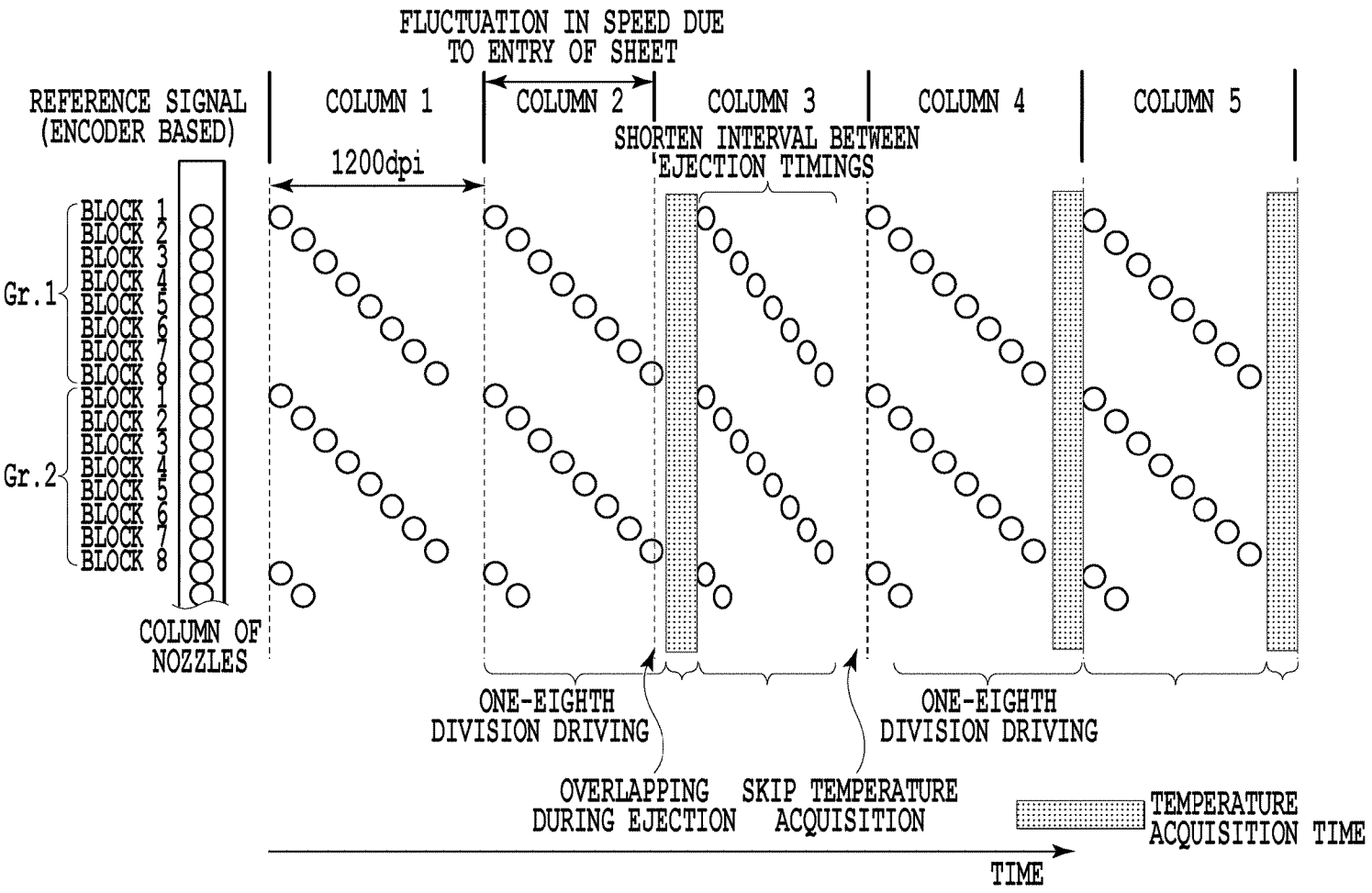
FIG. 29 is a diagram for explaining an example of the time division driving according to a sixth embodiment of the present invention.

FIG. 29 is a diagram for explaining an example of the time division driving according to a sixth embodiment of the present invention. In the present embodiment, there is performed processing for skipping the temperature acquisition of the next column of a column in which overlapping of the reference signal occurs, and at the same time, the interval between ejection timings is shortened. The example illustrated in FIG. 29 is an example in which the ejection at the eighth block of the column 2 overlaps with the reference signal, as in the example illustrated in FIG. 25. In the present embodiment, in response to this, the temperature acquisition of the next column 3 is skipped and at the same time, the interval between ejection timings of the column 3 is shortened. Accordingly, from the column 4, the ejection can be performed at the normal ejection-timing.

Figure 30:
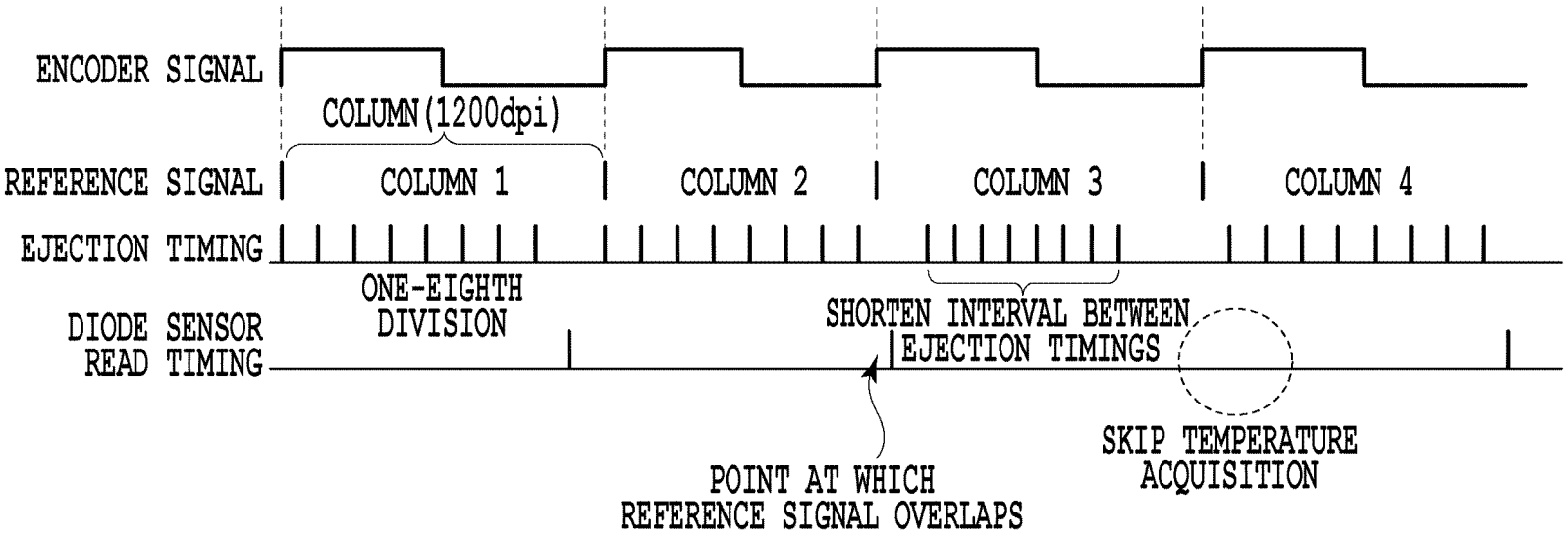
FIG. 30 is a timing chart of each signal generated by the print timing generation unit in the time division driving illustrated in FIG. 29.

FIG. 30 is the timing chart of each signal generated by the print timing generation unit 208 in the time division driving illustrated in FIG. 29. As illustrated in FIG. 30, in the column 3, processing for skipping the temperature acquisition is performed and at the same time, the interval between ejection timings is shortened. Accordingly, from the column 4, the ejection can be performed at the normal ejection-timing, and also the temperature acquisition can be performed at the normal temperature-acquisition timing.

Note that, in the configuration for shortening the interval between ejection timings, a block trigger interval shorter than the usual is preset in a hardware register, the fact that the overlapping of a reference signal occurred is latched by the hardware, and then at a timing when the next encoder signal enters, an ejection timing signal is generated on the basis of the block trigger interval information preset in the register. The specific examples of the block trigger interval preset in the register are considered to include for example the minimum block trigger interval etc.

Note that, in the fourth embodiment, fifth embodiment, and sixth embodiment, the timing chart of the head drive data, the latch signal, and the clock signal, which are output and transmitted from the print-data transfer circuit of the printing control unit 209, and the drive circuit of the printing head are those in FIG. 12 and FIG. 13, respectively. Namely, the timing chart and the drive circuit are similar to those of the first embodiment etc., and thus the detailed description thereof is omitted.

Other Embodiments

Figure 31:
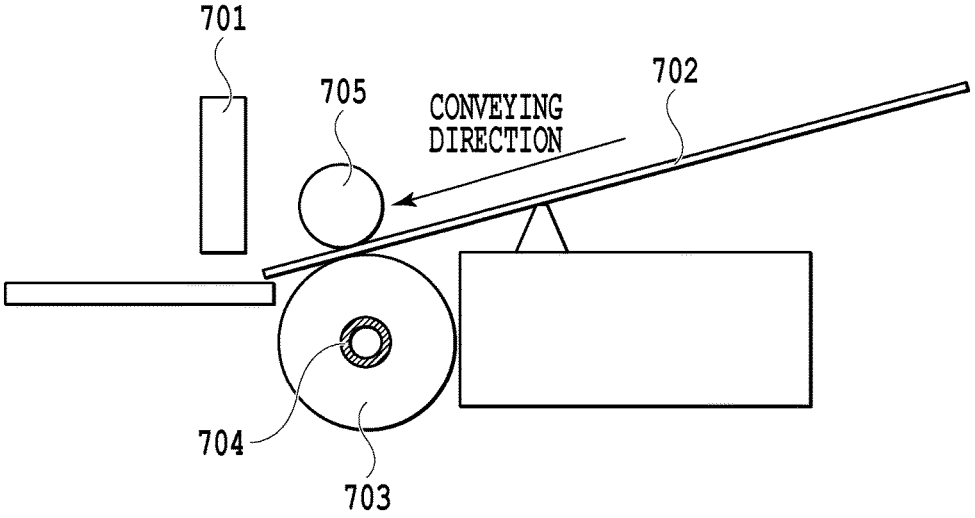
FIG. 31 is a diagram for illustrating the configuration of another embodiment of a printing unit of an inkjet printing apparatus.

The present invention is not limited to the form of the printing apparatus of the above-described configuration. The present invention is also applicable to a fluctuation in speed which is generated when a printing sheet comes off from a conveying roller in a printing apparatus or the like having a form of directly drawing onto a printing sheet. FIG. 31 is a diagram for illustrating the configuration of another embodiment of a printing unit of an inkjet printing apparatus. In a printing head 701, a plurality of columns of nozzles for different ink colors is arranged in the conveying direction of a printing medium 702. An image is printed onto the printing medium 702 by sequentially ejecting ink from each column of nozzles. The printing head 701 is a line-type printing head having a column of nozzles provided in a range which covers the maximum width of the printing medium 702, assumed to be used. A plurality of columns of nozzles ejects a plurality of colors of ink: e.g., inks of C (cyan), M (Magenta), Y (yellow), and K (black). Note that the number of colors is not limited to four.

A conveying roller 703 and a pinch roller 705 constitute a conveying mechanism for conveying the printing medium 702, in which the pinch roller 705 presses the printing medium 702 against the conveying roller 703, and at the same time, the conveying roller rotates to convey the printing medium 702. An encoder 704 is attached onto the rotary shaft of the conveying roller 703. The rotational position and speed of the conveying roller are detected by detecting the rotation of this encoder by the use of an encoder sensor. The above-described reference signal is generated on the basis of this detected encoder signal. Note that an encoder scale is not limited to being attached to the rotary shaft. Moreover, there is arranged a reference position sensor (not illustrated in the view) which outputs a signal for giving notification, once every time the encoder makes one round, of the point of origin of the encoder.

Moreover, the above-described embodiments relate to the time division driving in the case where a printing element in the printing head of an inkjet type is driven, but the present invention is not limited to this form. The present invention is applicable to printing apparatuses of any form which drives a printing element to thereby form a dot and print an image etc.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-204289, No. 2016-204294, and No. 2016-204290, each of which was filed Oct. 18, 2016, and, which are hereby incorporated by reference herein in their entireties.

What is claimed is:

1. A printing apparatus for printing, the printing apparatus comprising:

a printing head having a plurality of printing elements arranged in a predetermined direction, the printing head being for printing a column including dots aligned in the predetermined direction;

a conveying unit configured to convey a printing medium in a direction intersecting with the predetermined direction;

a signal acquisition unit configured to acquire a reference signal which is sequentially output in response to conveyance of the printing medium by the conveying unit; and a time-division driving unit configured to divide the plurality of printing elements into a plurality of blocks, and, in a time period after a target reference signal is acquired by the signal acquisition unit and until a next reference signal of the target reference signal is acquired, to drive the plurality of printing elements at a time interval for each of the blocks on a basis of the target reference signal to thereby perform one column of printing, wherein the time-division driving unit drives, in a case where, in a first column, a time after the target reference signal is acquired by the signal acquisition unit and until the next reference signal is acquired is shorter than a time required for driving the plurality of printing elements for one column of printing by the time-division driving unit, the plurality of printing elements so that a time required for driving the plurality of printing elements for one column of printing by the time-division driving unit in a second column, in which printing is performed after the first column, becomes shorter than a time required for driving the plurality of printing elements for one column of printing by the time-division driving unit in the first column.

2. The printing apparatus according to claim 1, wherein the time-division driving unit drives, in a case where, in the first column, a time after the target reference signal is acquired by the signal acquisition unit and until the next reference signal is acquired is shorter than a time required for driving the plurality of printing elements for one column of printing by the time-division driving unit, the plurality of printing elements so that a driving interval between the blocks for one column of printing by the time-division driving unit in the second column becomes shorter than a driving interval between the blocks for one column of printing by the time-division driving unit in the first column.

3. The printing apparatus according to claim 2, wherein the time-division driving unit drives, in a case where, in the first column, a time after the target reference signal is acquired by the signal acquisition unit and until the next reference signal is acquired is shorter than a time required for driving the plurality of printing elements for one column of printing by the time-division driving unit, the plurality of printing elements so that the shorter the time after the target reference signal is acquired by the signal acquisition unit and until the next reference signal is acquired, the shorter a drive interval between the blocks for one column of printing by the time-division driving unit in the second column becomes.

4. The printing apparatus according to claim 3, wherein (i) the time-division driving unit drives, in a case where, in the first column, a time after the target reference signal is acquired by the signal acquisition unit and until the next reference signal is acquired is shorter than a time required for driving the plurality of printing elements for one column of printing by the time-division driving unit and is also longer than a predetermined threshold time, the plurality of printing elements so that the shorter the time after the target reference signal is acquired by the signal acquisition unit and until the next reference signal is acquired, the shorter a drive interval between the blocks for one column of printing by the time-division driving unit in the second column becomes, and (ii) the time-division driving unit fixes, in a case where, in the first column, a time after the target reference signal is acquired by the signal acquisition unit and until the next reference signal is acquired is shorter than a time required for driving the plurality of printing elements for one column of printing by the time-division driving unit and is also shorter than a predetermined threshold time, a drive interval between the blocks for one column of printing by the time-division driving unit in the second column regardless of the time after the target reference signal is acquired by the signal acquisition unit and until the next reference signal is acquired.

5. The printing apparatus according to claim 1, wherein the time-division driving unit drives, in a case where, in the first column, a time after the target reference signal is acquired by the signal acquisition unit and until the next reference signal is acquired is shorter than a time required for driving the plurality of printing elements for one column of printing by the time-division driving unit, the plurality of printing elements so that a division number of the blocks for one column of printing by the time-division driving unit in the second column becomes smaller than a division number of the blocks for one column of printing by the time-division driving unit in the first column.

6. The printing apparatus according to claim 5, wherein the time-division driving unit drives, in a case where, in the first column, a time after the target reference signal is acquired by the signal acquisition unit and until the next reference signal is acquired is shorter than a time required for driving the plurality of printing elements for one column of printing by the time-division driving unit, the plurality of printing elements so that the shorter the time after the target reference signal is acquired by the signal acquisition unit and until the next reference signal is acquired, the smaller a division number of the blocks for one column of printing by the time-division driving unit in the second column becomes.

7. The printing apparatus according to claim 1, further comprising:

a measurement unit configured to measure a time elapsed after the target reference signal is acquired by the signal acquisition unit; and a determination unit configured to determine that, in a case where the next reference signal is acquired before a time measured by the measurement unit becomes a predetermined time, a time after the target reference signal is acquired by the signal acquisition unit and until the next reference signal is acquired is shorter than a time required for driving the plurality of printing elements for one column of printing by the time-division driving unit.

8. A printing apparatus for printing, the printing apparatus comprising:

a printing head having a plurality of printing elements arranged in a predetermined direction, the printing head being for printing a column including dots aligned in the predetermined direction;

a conveying unit configured to convey a printing medium in a direction intersecting with the predetermined direction;

a signal acquisition unit configured to acquire a reference signal which is sequentially output in response to conveyance of the printing medium by the conveying unit;

a time-division driving unit configured to divide the plurality of printing elements into a plurality of blocks, and, in a time period after a target reference signal is acquired by the signal acquisition unit and until a next reference signal of the target reference signal is acquired, to drive the plurality of printing elements at a time interval for each of the blocks on a basis of the target reference signal to thereby perform one column of printing; and an information acquisition unit configured to acquire head information about the printing head in a time period after the target reference signal is acquired by the signal acquisition unit and until the next reference signal is acquired, wherein the information acquisition unit cancels, in a case where, in a first column, a time after the target reference signal is acquired by the signal acquisition unit and until the next reference signal is acquired is shorter than a time required for driving the plurality of printing elements for one column of printing by the time-division driving unit and for acquiring the head information by the information acquisition unit, an operation related to the head information in a second column in which printing is performed after the first column.

9. The printing apparatus according to claim 8, wherein the operation related to the head information is an acquisition operation of the head information acquired by the information acquisition unit.

10. The printing apparatus according to claim 8, wherein the operation related to the head information is a processing operation of the head information acquired by the information acquisition unit.

11. The printing apparatus according to claim 8, wherein the head information is information indicative of temperature of the printing head.

12. The printing apparatus according to claim 8, wherein the time-division driving unit drives, in a case where, in the first column, a time after the target reference signal is acquired by the signal acquisition unit and until the next reference signal is acquired is shorter than a time required for driving the plurality of printing elements for one column of printing by the time-division driving unit, the plurality of printing elements so that a time required for driving the plurality of printing elements for one column of printing by the time-division driving unit in a second column in which printing is performed after the first column becomes shorter than a time required for driving the plurality of printing elements for one column of printing by the time-division driving unit in the first column.

13. The printing apparatus according to claim 8, further comprising:

a measurement unit configured to measure a time elapsed after the target reference signal is acquired by the signal acquisition unit; and a determination unit configured to determine that, in a case where the next reference signal is acquired before the time measured by the measurement unit becomes a predetermined time, a time after the target reference signal is acquired by the signal acquisition unit and until the next reference signal is acquired is shorter than a time required for driving the plurality of printing elements for one column of printing by the time-division driving unit.

14. A printing method for printing by a printing apparatus including a printing head having a plurality of printing elements arranged in a predetermined direction, the printing head being for printing a column including dots aligned in the predetermined direction, and a conveying unit configured to convey a printing medium in a direction intersecting with the predetermined direction, the method comprising:

a signal acquisition step of acquiring a reference signal which is sequentially output in response to conveyance of the printing medium by the conveying unit; and a time-division driving step of dividing the plurality of printing elements into a plurality of blocks, and, in a time period after a target reference signal is acquired in the signal acquisition step and until a next reference signal of the target reference signal is acquired, of driving the plurality of printing elements at a time interval for each of the blocks on a basis of the target reference signal to thereby perform one column of printing, wherein, in the time-division driving step, in a case where, in the first column, a time after the target reference signal is acquired and until the next reference signal is acquired in the signal acquisition step is shorter than a time required for driving the plurality of printing elements for performing one column of printing in the time-division driving step, the plurality of printing elements is driven so that a time required for driving the plurality of printing elements for one column of printing in the time-division driving step in a second column in which printing is performed after the first column becomes shorter than a time required for driving the plurality of printing elements for one column of printing in the time-division driving step in the first column.

15. The printing method according to claim 14, wherein, in the time-division driving step, in a case where, in the first column, a time after the target reference signal is acquired and until the next reference signal is acquired in the signal acquisition step is shorter than a time required for driving the plurality of printing elements for performing one column of printing in the time-division driving step, the plurality of printing elements is driven so that a driving interval between the blocks for one column of printing in the time-division driving step in the second column becomes shorter than a driving interval between the blocks for one column of printing in the time-division driving step in the first column.

16. The printing method according to claim 14, wherein, in the time-division driving step, in a case where, in the first column, a time after the target reference signal is acquired and until the next reference signal is acquired in the signal acquisition step is shorter than a time required for driving the plurality of printing elements for performing one column of printing in the time-division driving step, the plurality of printing elements is driven so that a division number of the blocks for one column of printing in the time-division driving step in the second column becomes smaller than a division number of the blocks for one column of printing in the time-division driving step in the first column.

17. The printing method according to claim 14, further comprising:

a measurement step of measuring a time elapsed after the target reference signal is acquired in the signal acquisition step; and a determination step of determining, in a case where the next reference signal is acquired before the time measured in the measurement step becomes a predetermined time, that a time after the target reference signal is acquired and until the next reference signal is acquired in the signal acquisition step is shorter than a time required for driving the plurality of printing elements for performing one column of printing in the time-division driving step.

18. A printing method for printing by a printing apparatus including a printing head having a plurality of printing elements arranged in a predetermined direction, the printing head being for printing a column including dots aligned in the predetermined direction, and a conveying unit configured to convey a printing medium in a direction intersecting with the predetermined direction, the method comprising:

a signal acquisition step of acquiring a reference signal which is sequentially output in response to conveyance of the printing medium by the conveying unit;

a time-division driving step of dividing the plurality of printing elements into a plurality of blocks, and, in a time period after a target reference signal is acquired in the signal acquisition step and until a next reference signal of the target reference signal is acquired, of driving the plurality of printing elements at a time interval for each of the blocks on a basis of the target reference signal to thereby perform one column of printing; and an information acquisition step of acquiring head information about the printing head in a time period after the target reference signal is acquired and until the next reference signal is acquired in the signal acquisition step, wherein, in the information acquisition step, in a case where, in the first column, a time after the target reference signal is acquired and until the next reference signal is acquired in the signal acquisition step is shorter than a time required for driving the plurality of printing elements for performing one column of printing in the time-division driving step and for acquiring the head information in the information acquisition step, an operation related to the head information is cancelled in a second column in which printing is performed after the first column.

19. The printing method according to claim 18, wherein, in the time-division driving step, in a case where, in the first column, a time after the target reference signal is acquired and until the next reference signal is acquired in the signal acquisition step is shorter than a time required for driving the plurality of printing elements for performing one column of printing in the time-division driving step, the plurality of printing elements is driven so that a time required for driving the plurality of printing elements for one column of printing in the time-division driving step in a second column in which printing is performed after the first column becomes shorter than a time required for driving the plurality of printing elements for one column of printing in the time-division driving step in the first column.

20. The printing method according to claim 18, further comprising:

a measurement step of measuring a time elapsed after the target reference signal is acquired in the signal acquisition step; and a determination step of determining, in a case where the next reference signal is acquired before the time measured in the measurement step becomes a predetermined time, that a time after the target reference signal is acquired and until the next reference signal is acquired in the signal acquisition step is shorter than a time required for driving the plurality of printing elements for performing one column of printing in the time-division driving step.

* * * * *